US010602782B2

(12) United States Patent
Halbert

(10) Patent No.: US 10,602,782 B2
(45) Date of Patent: Mar. 31, 2020

(54) CONCEALED ENGAGING CLIP AND ANCHOR FOR FIXEDLY ASSOCIATING UPPER BODY CLOTHING WITH LOWER BODY CLOTHING TO PRESERVE A WEARER'S NEAT APPEARANCE

(71) Applicant: James G. Halbert, Scottsville, NY (US)

(72) Inventor: James G. Halbert, Scottsville, NY (US)

( * ) Notice: Subject to any disclaimer, the term of this patent is extended or adjusted under 35 U.S.C. 154(b) by 0 days.

(21) Appl. No.: 16/120,945

(22) Filed: Sep. 4, 2018

(65) Prior Publication Data

US 2019/0069608 A1 Mar. 7, 2019

Related U.S. Application Data

(63) Continuation-in-part of application No. 14/161,879, filed on Jan. 23, 2014, now abandoned.

(51) Int. Cl.
*A41B 1/08* (2006.01)
*A44B 99/00* (2010.01)

(52) U.S. Cl.
CPC ..... *A41B 1/08* (2013.01); *A44B 99/00* (2013.01)

(58) Field of Classification Search
CPC . A44B 99/00; A41F 19/00; A41F 5/00; A41B 1/08; Y10T 24/45037; Y10T 24/45067; Y10T 24/44043; Y10T 24/4406; Y10T 24/23
See application file for complete search history.

(56) References Cited

U.S. PATENT DOCUMENTS 5,632,069 A * 5/1997 Mievis ..... A41F 5/00 24/333
2015/0201689 A1* 7/2015 Halbert ..... A41F 17/02 2/312

FOREIGN PATENT DOCUMENTS

JP 2012224963 A * 11/2012

* cited by examiner

*Primary Examiner* — Robert Sandy
(74) *Attorney, Agent, or Firm* — Hulsey, PC

(57) ABSTRACT

An apparel securing mechanism anchors upper body clothing to lower body clothing to preserve a neat appearance of a wearer. An anchor mechanism anchors an upper body clothing and conceals an apparel securing mechanism within the upper body clothing. A locking retainer tube removably engages the anchor tab. An anchor outer casing affixes to and substantially surrounds the locking retainer tube. The anchor outer casing and the locking retainer tube may be surrounded by the shirt-weight fabric. An engaging clip forms a concealed and firm anchoring with the anchor mechanism. A belt ledge grabbing channel firmly positions the engaging clip in fixed association with the lower body clothing. The engaging clip and the anchor mechanism fixedly associate the upper body clothing with the lower body clothing while being concealed by the upper body clothing and the lower body clothing to preserve a neat appearance of a wearer.

17 Claims, 17 Drawing Sheets

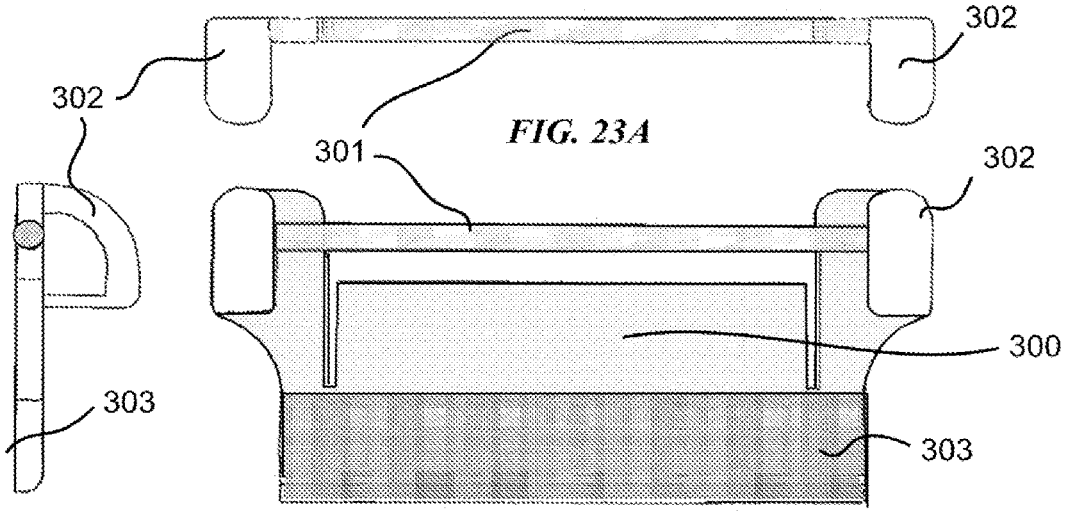
FIG. 23A
FIG. 23B
FIG. 23C
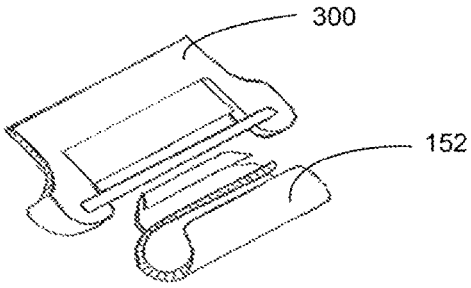
FIG. 24A
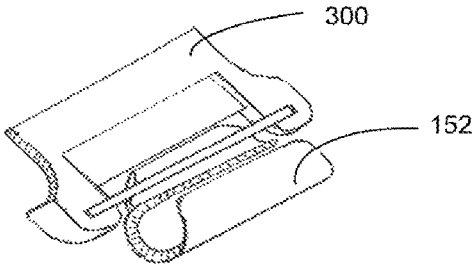
FIG. 24B
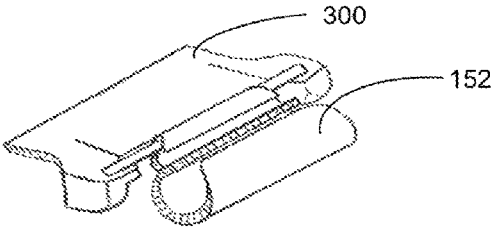
FIG. 24C
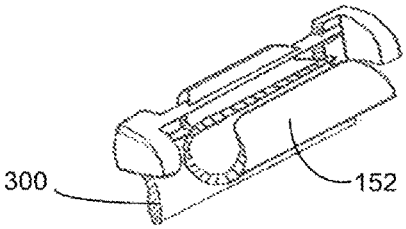
FIG. 24D

CONCEALED ENGAGING CLIP AND ANCHOR FOR FIXEDLY ASSOCIATING UPPER BODY CLOTHING WITH LOWER BODY CLOTHING TO PRESERVE A WEARER'S NEAT APPEARANCE

CROSS REFERENCE TO RELATED APPLICATIONS

This application further claims the benefit of the following non-provisional application, which is here expressly incorporated by reference: U.S. patent application Ser. No. 14/161,879 entitled "GARMENT ENGAGEMENT SYSTEM," filed on Jan. 23, 2014.

FIELD OF THE INVENTION

The continuation in part disclosure relates to additional components enhancing the performance and usability of a system for engaging and securing at least one garment.

BACKGROUND OF THE INVENTION

Under strenuous conditions stemming from everyday tasks, garments are prone to "riding up" and becoming undesirably positioned. Additional difficulty results from carrying heavy items attached to the belt or in the pockets causing the lower body garments to slip down. There is often a need to find a private location to re-adjust the garments. This is often followed by frustration of the wearers of the garments. For as long as the textile industry has existed, there is not a reasonable solution for these problems.

Previous garment engagement systems have utilized elements such as Velcro, straps, and elongated arms. Although some of these systems may work, they introduce new problems when it comes to securing garments. Other problems arise when attempting to attach non-garment devices securely. These systems fail while supporting weight exerted on the systems by gravity and inertia. Other difficulties include discomfort and complications related to tightness of straps and the pulling and constraint of elastic straps.

Accordingly, a need exists for a garment engagement system that displays simplicity, efficiency in the containment of garments, and support of lower body garments while attaching non-garment devices to garments with locking mechanisms and supporting the load of the devices. While previous aspects of the invention are applicable and does provide an effective way to contain a garment and provides a working solution to attach non-garment device to garment, a further improved method that is gentler on the fabric of the garment was desired. Additionally a means to easily adjust the Garment Engagement System (GES) to variety garment thicknesses was sought.

Connectivity of non-garment devices to the GES is enhanced by allowing an attachment device to inter-connect between GES and a variety of devices like, but not limited to, electronic devices, cameras, eyeglass cases and carry cases. This also allows an attached device to pivot, allowing viewing of electronic device screens without detachment from the GES.

An improved 'belt ledge retainer' provides a means to connect an attachment device to the GES.

SUMMARY OF THE INVENTION

The disclosure at hand provides a system for engaging and keeping an individual's garment in a confined state. The engagement clip of the garment engagement system comprises an interior surface and an exterior surface wherein at least one anchor is positionable within the engagement clip to define a space between the engagement clip and an anchor. The engagement clip further comprises a channel extending between the interior surface and exterior surface of the engagement clip. The interior or exterior surfaces of the engagement clip may be textured. A housing may also be included in the garment engagement system.

The system further includes a belt ledge retainer configured to at least partially retain a belt in close proximity to the engagement clip. At least one ferromagnetic element may be utilized in conjunction with the system, wherein at least one of the ferromagnetic elements is adjacent to the exterior of the engagement clip and removably attached to the system. The ferromagnetic elements define an additional space adapted to engage a belt, garment, or combination thereof. In certain embodiments, at least one ferromagnetic element may take the place of the belt ledge retainer. In other embodiments, ferromagnetic elements may be absent.

The system may further comprise a belt with a length sufficient to circumnavigate said individual in order to retain the anchors with the help of securing wires or C-wires. Flexible anchors are used in the system in conjunction with an engagement clip. In further embodiments, a rigid anchor may be used in conjunction with an engagement clip. Other embodiments may include a compound anchor to retain securing wires.

The diameter of the anchor is smaller in diameter than the interior surface of the engagement clip to allow for the anchor to properly slide into the engagement clip whether engulfed in a textile or not engulfed in a textile.

The garment engagement system may be further utilized in relation with hand gun holsters, pockets, electronic device holders, eye glass cases, and body armor.

Accordingly, it is a principal object of the current disclosure to overcome the disadvantages of previous garment engagement systems due to its simplicity, efficient containment of garments, and inclusion of trouser support.

These and other aspects of the disclosed subject matter, as well as additional novel features, will be apparent from the description provided herein. The intent of this summary is not to be a comprehensive description of the subject matter, but rather to provide a short overview of some of the subject matter's functionality.

Other systems, methods, features and advantages here provided will become apparent to one with skill in the art upon examination of the following FIGURES and detailed description It is intended that all such additional systems, methods, features and advantages that are included within this description, be within the scope of any claims filed later.

The presently disclosed subject matter includes a channel extending between the interior surface and the exterior surface of the belt ledge grabbing retainer and defines a space to receive a cylindrical bar the length of the belt ledge grabbing retainer.

The presently disclosed subject matter further includes a rigid anchor tab used in conjunction with the engagement clip and a removably attached fabric strip securing the anchor assembly to a securing belt. The current disclosure further provides for easy attachment and removal of attached devices.

In another aspect, the present disclosure provides a method, system, and integrated apparel securing mechanism for anchoring an upper body clothing to lower body piece of clothing to preserve a neat appearance of a wearer throughout a variety of movements and over an extended period of time. The present disclosure includes an anchor mechanism for anchoring an upper body clothing and formed of a semi-rigid material. The anchoring tab positions and conceals the apparel securing mechanism within the upper body clothing, wherein the upper body clothing is formed of a shirt-weight fabric. The anchoring tab has a width of less than approximately six inches and a height of less than approximately four inches and a generally flat configuration for being concealed beneath the upper body clothing. A locking retainer tube removably engages the anchor tab and has a tubular form and a length of less than approximately four inches. The tubular form diameter is less than approximately one inch. An anchor outer casing affixes to and substantially surrounds the locking retainer tube. The anchor outer casing and the locking retainer tube may be surrounded by the shirt-weight fabric. This, thereby firmly associates the shirt-weight fabric and, thereby, the upper body clothing with the anchoring tab. An engaging clip for engages a lower body clothing. The engaging clip firmly engages the shirt-weight fabric surrounding the anchor outer casing and the locking retainer tube to form a concealed and firm anchoring of the engaging clip with the anchor mechanism. The engaging clip may be formed of a semi-rigid material of a generally tubular form with an inner diameter sufficient for firmly receiving the shirt-weight fabric surrounding the anchor outer casing and the locking retainer tube, and a tubular length approximately equivalent to the locking retainer tube. The engaging clip further comprises a belt ledge grabbing channel for grabbing a belt surrounding the lower body clothing and using the belt for firmly positioning the engaging clip in fixed association with the lower body clothing. With this formation, the engaging clip and the anchor mechanism fixedly associates the upper body clothing with the lower body clothing while being concealed by the upper body clothing and the lower body clothing to thereby preserve a neat appearance of a wearer throughout a variety of movements and over an extended period of time.

BRIEF DESCRIPTION OF THE DRAWINGS

The novel features believed characteristic of the disclosed subject matter will be set forth in claims that follow. The disclosed subject matter itself, however, as well as a preferred mode of use, further objectives, and advantages thereof, will best be understood by reference to the following detailed description of an illustrative embodiment when read in conjunction with the accompanying drawings, wherein:

[0016]

Figure 2A:
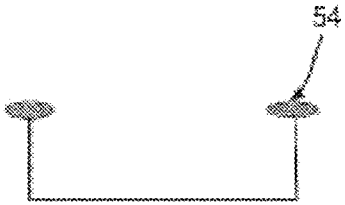

FIG. 2A depicts a securing wire according to an embodiment of the current disclosure.

Figure 2B:
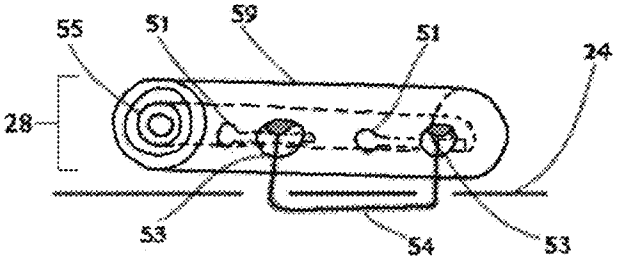

FIG. 2B depicts a side view of a securing wire and compound anchor according to an embodiment of the current disclosure.

Figure 3B:
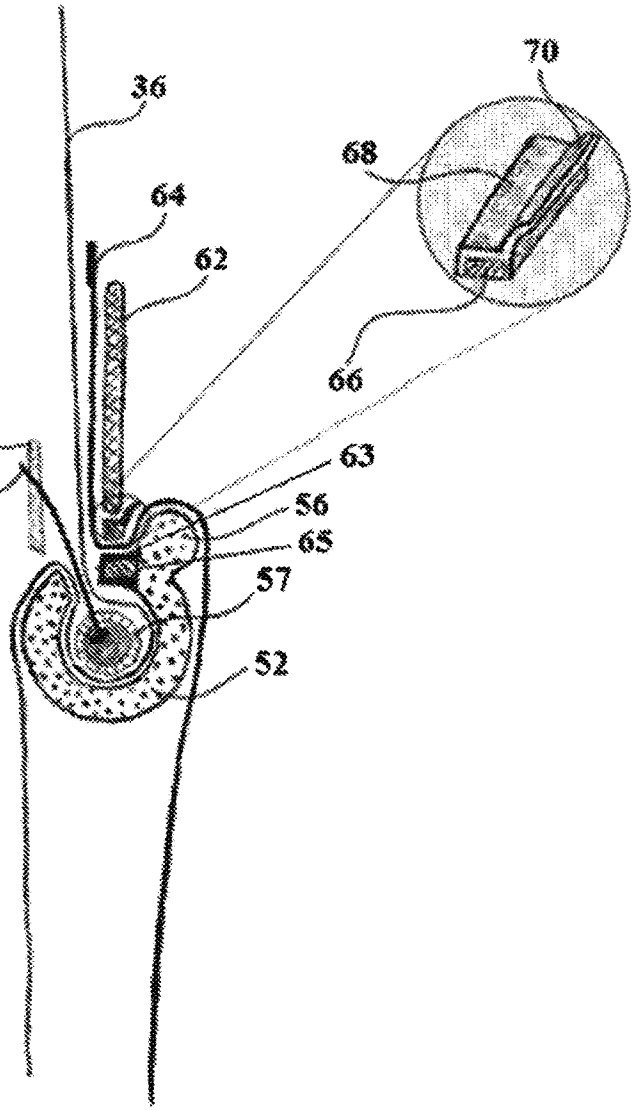
Figure 3A:
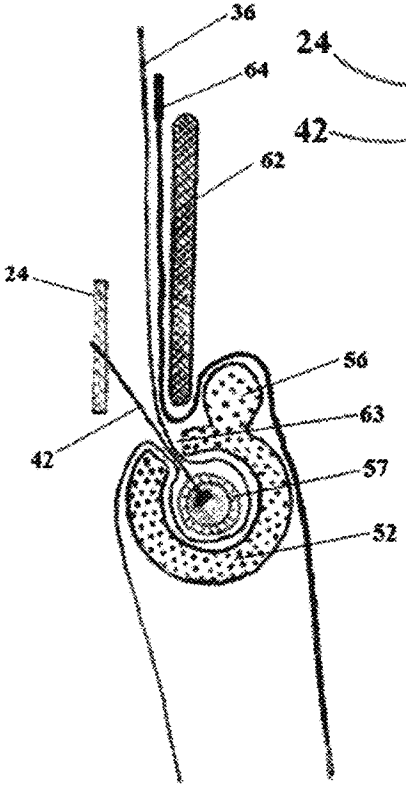

FIG. 3A depicts a side view of a belt and garment engagement system engaging more than one garment according to an embodiment of the current disclosure.

FIG. 3B depicts a side view of a belt and garment engagement system including a plurality of ferromagnetic elements engaging more than one garment according to an embodiment of the current disclosure.

Figure 4:
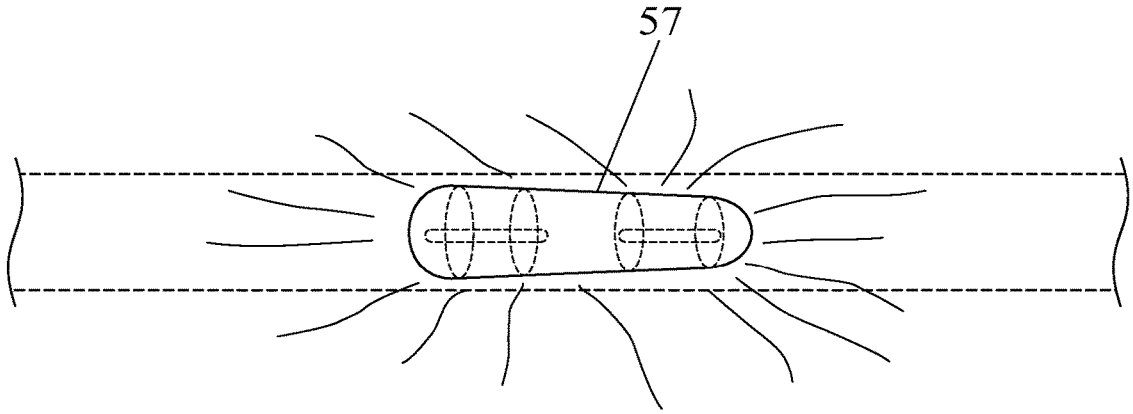

FIG. 4 depicts a front/internal view of a flexible anchor engulfed in a garment according to an embodiment of the current disclosure.

Figure 5:
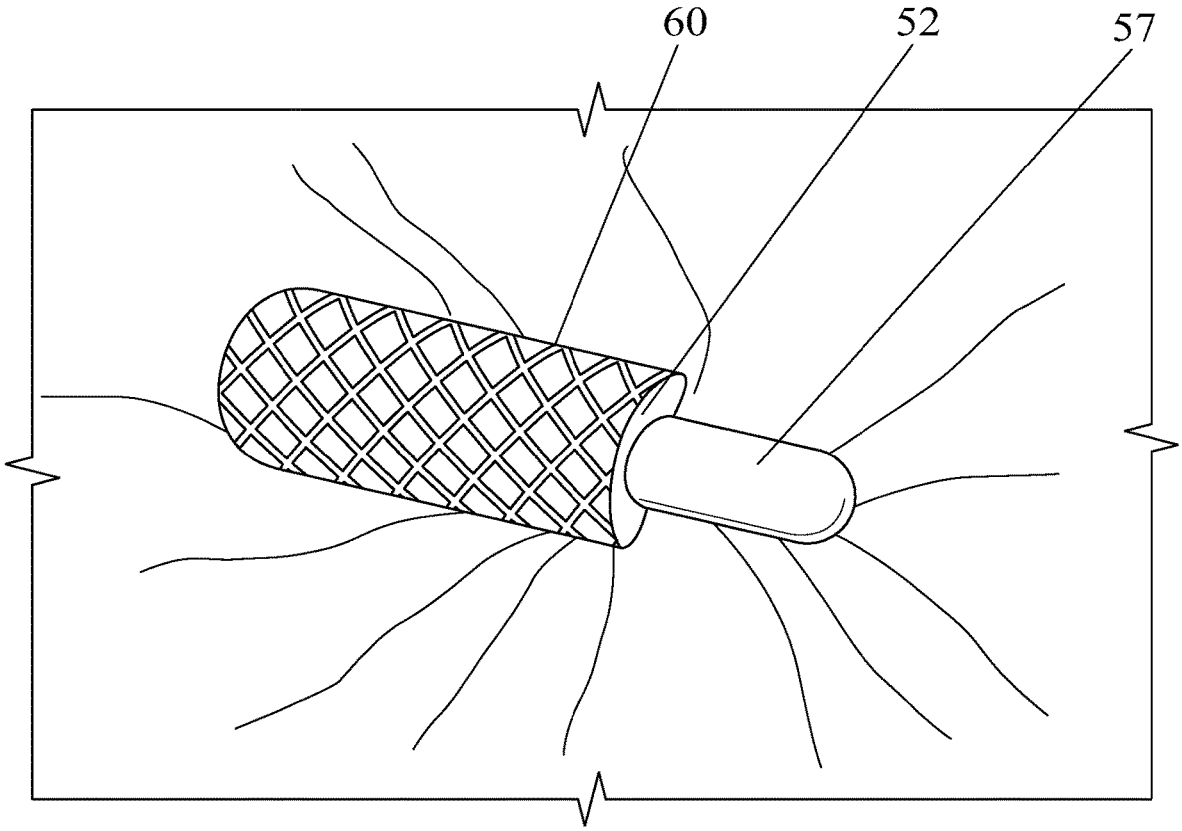

FIG. 5 depicts a textured housing and engagement clip slid partially over a flexible anchor engulfed in a garment according to an embodiment of the current disclosure.

Figure 6:
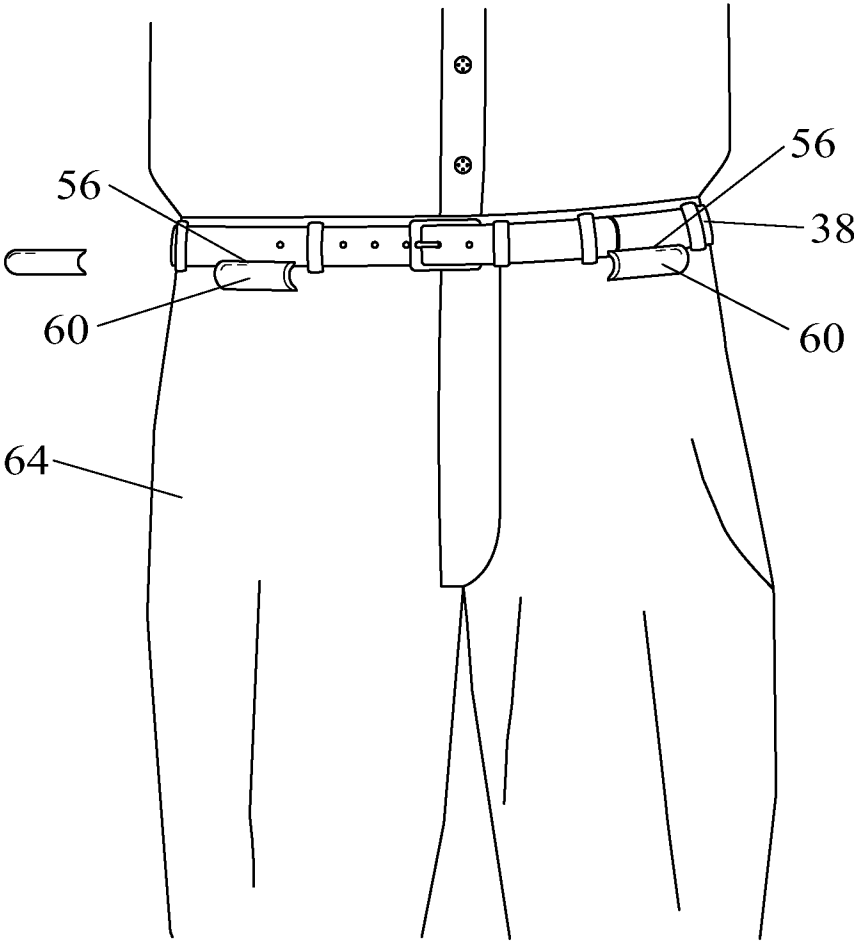

FIG. 6 depicts a front view of a garment engagement system engaging a garment while "hidden" under a pair of pants according to an embodiment of the current disclosure.

Figure 7:
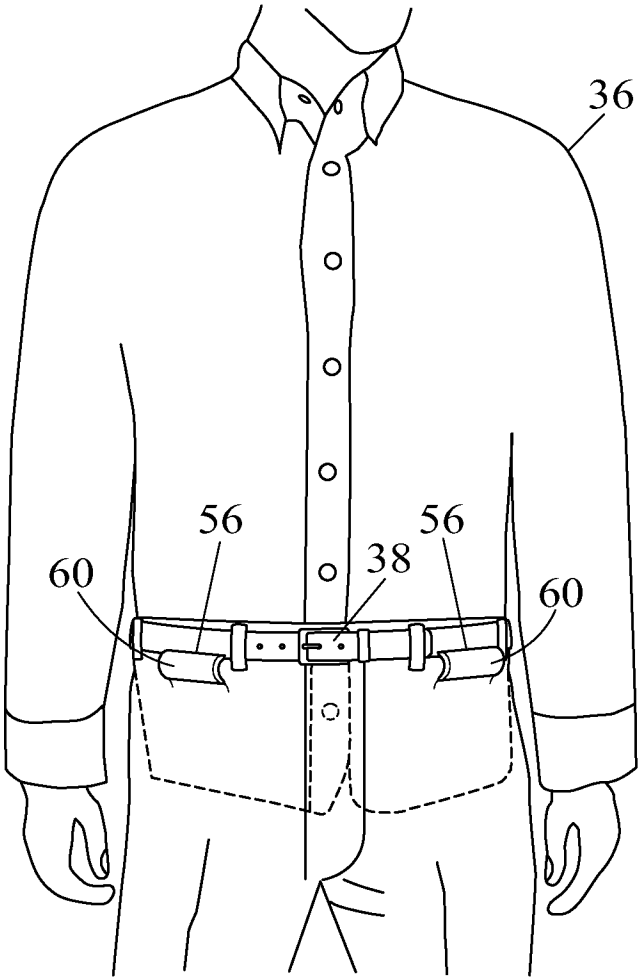

FIG. 7 depicts an internal view of a garment engagement system engaging a garment while "hidden" under a pair of pants according to an embodiment of the current disclosure.

Figure 8:
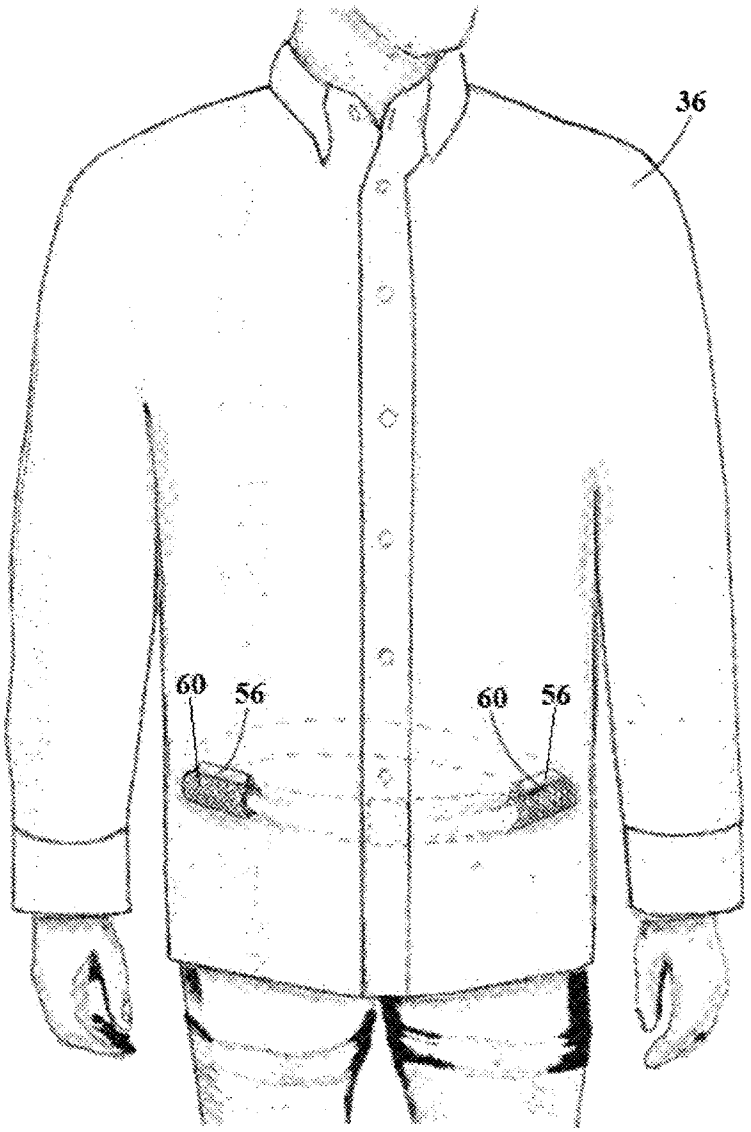

FIG. 8 depicts a front view of a garment engagement system depicting an internal view of a securing belt attached to the garment engagement system according to an embodiment of the current disclosure.

Figure 9A:
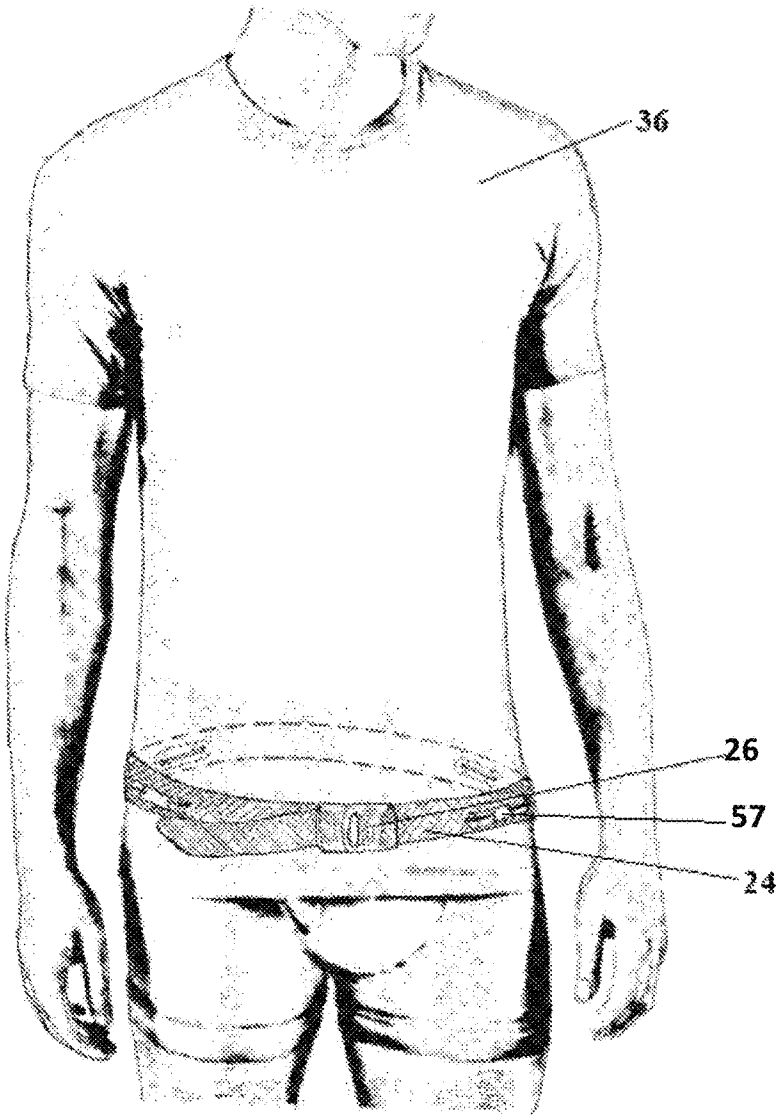

FIG. 9A depicts a front view of a belt and flexible anchors according to an embodiment of the current disclosure.

Figure 9B:
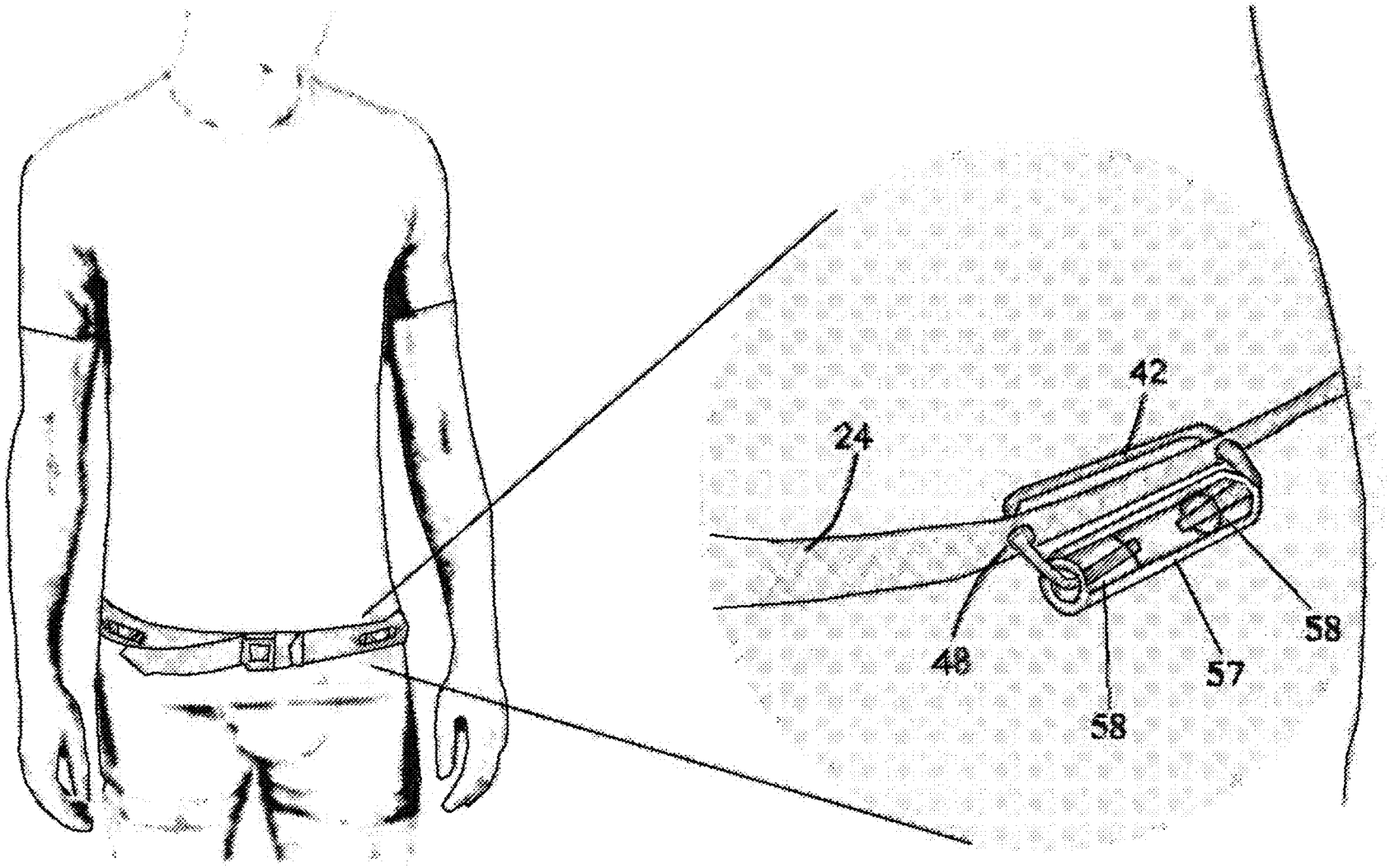

FIG. 9B depicts a magnified view of a belt and flexible anchors according to an embodiment of the current disclosure.

Figure 10A:
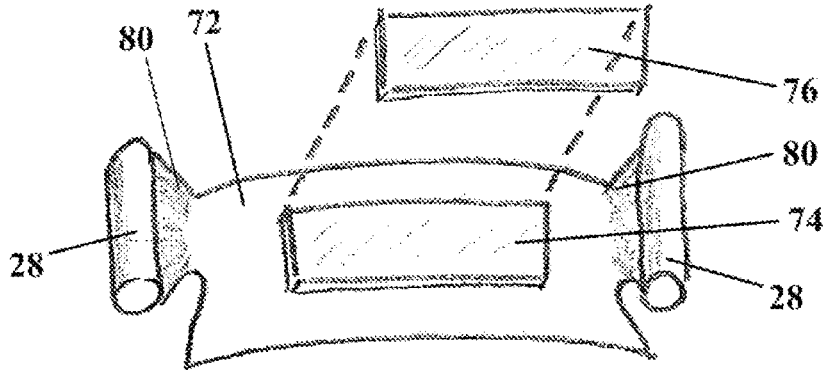

FIG. 10A depicts a front view of an anchor plate section of an electronic device holder according to an embodiment of the current disclosure.

Figure 10B:
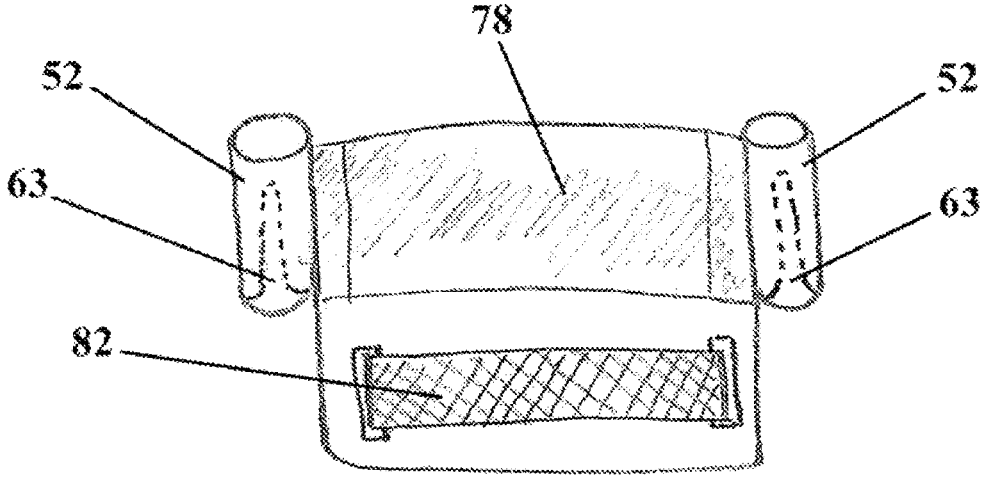

FIG. 10B depicts a front view of an engagement clip section of an electronic device and eyeglass holder according to an embodiment of the current disclosure.

Figure 10C:
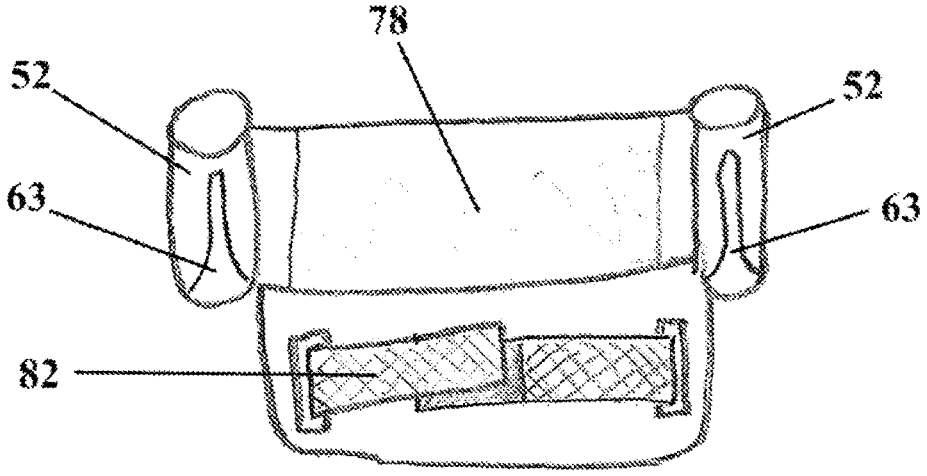

FIG. 10C depicts a back view of an engagement clip section of an electronic device and eyeglass holder according to an embodiment of the current disclosure.

Figure 11A:
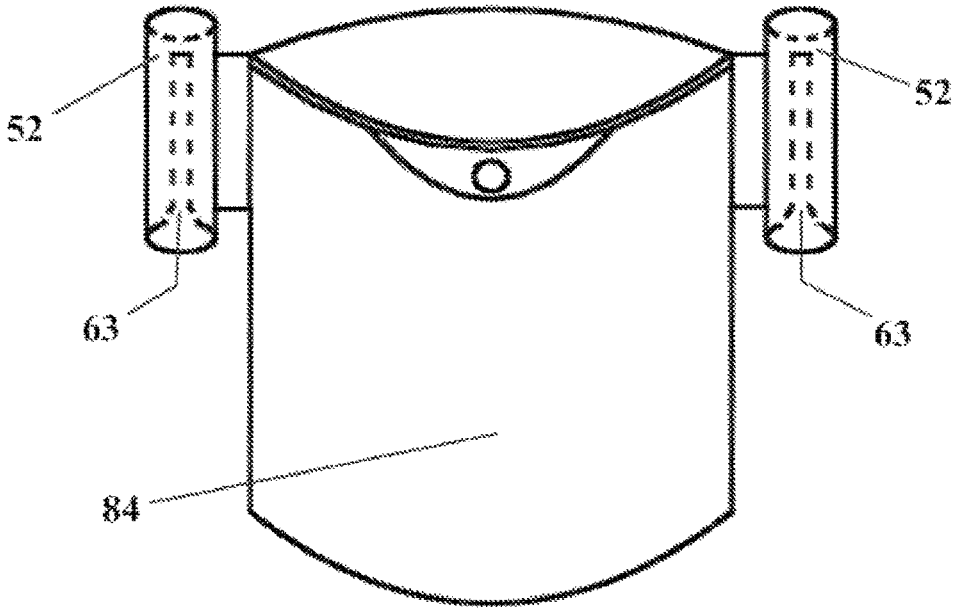

FIG. 11A depicts a front view of an engagement clip pocket section according to an embodiment of the current disclosure.

Figure 11B:
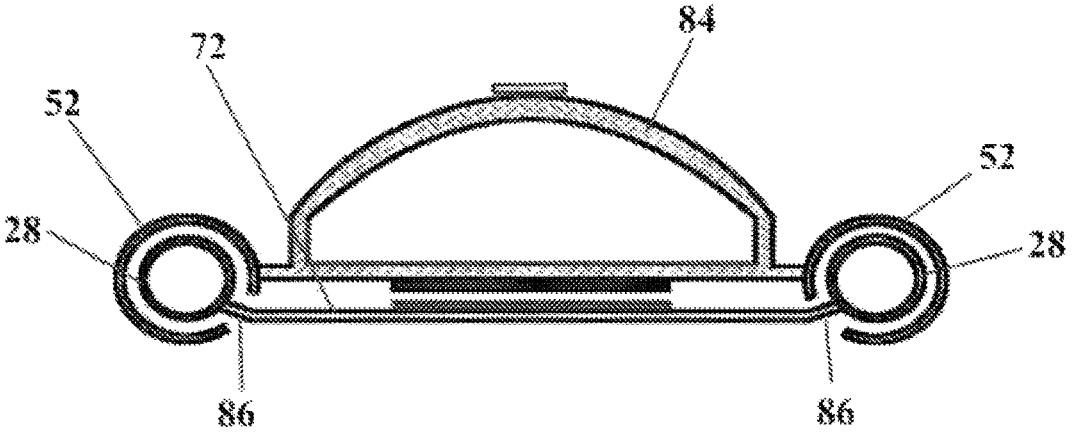

FIG. 11B depicts a top view of an anchor plate section in conjunction with an engagement clip pocket section according to an embodiment of the current disclosure.

Figure 11C:
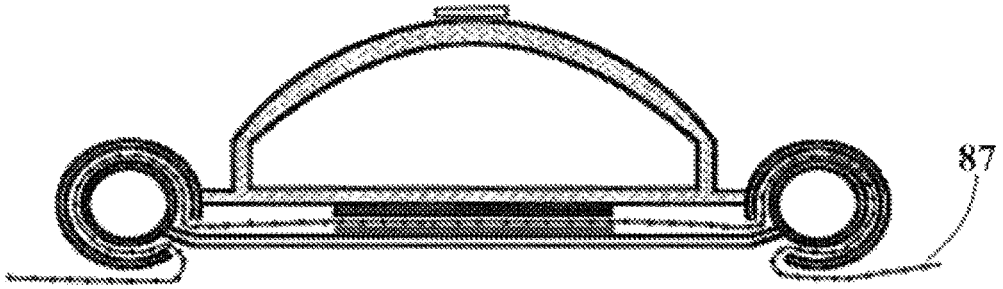

FIG. 11C depicts a top view of an anchor plate section in conjunction with an engagement clip pocket section engaging a garment according to an embodiment of the current disclosure.

Figure 12A:
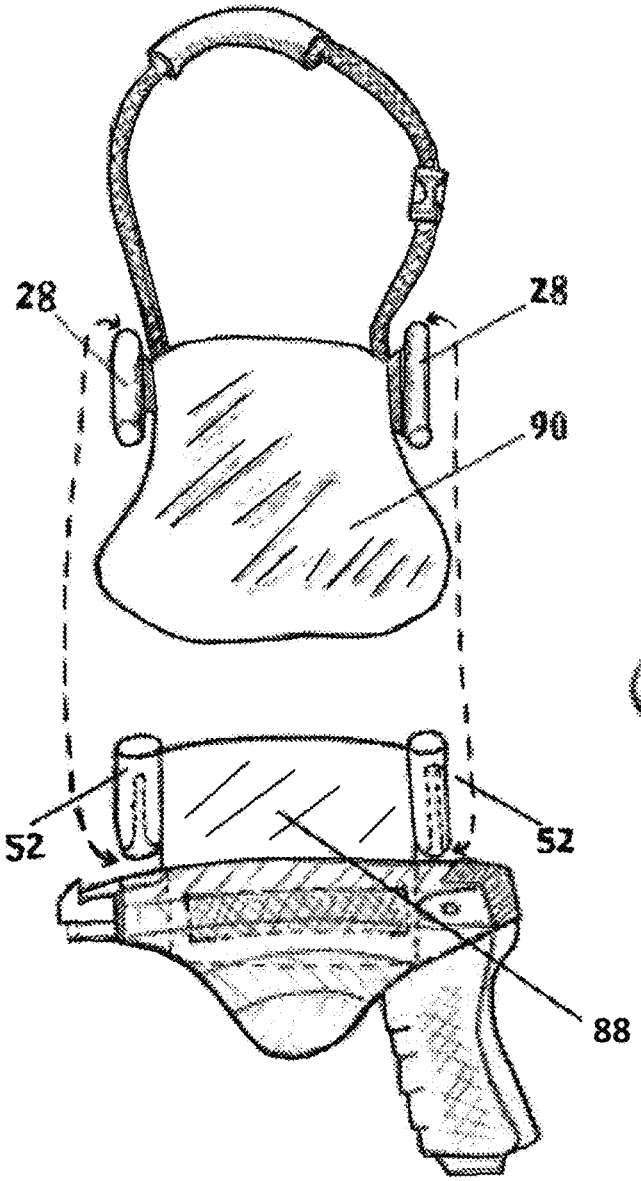

FIG. 12A depicts a front view of a gun holster system according to an embodiment of the current disclosure.

Figure 12B:
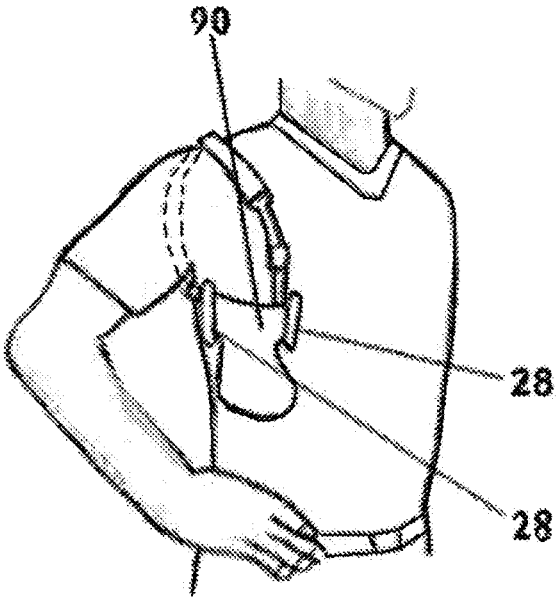

FIG. 12B depicts a side view of a user fitted with the anchor plate section of a gun holster system according to an embodiment of the current disclosure.

Figure 13:
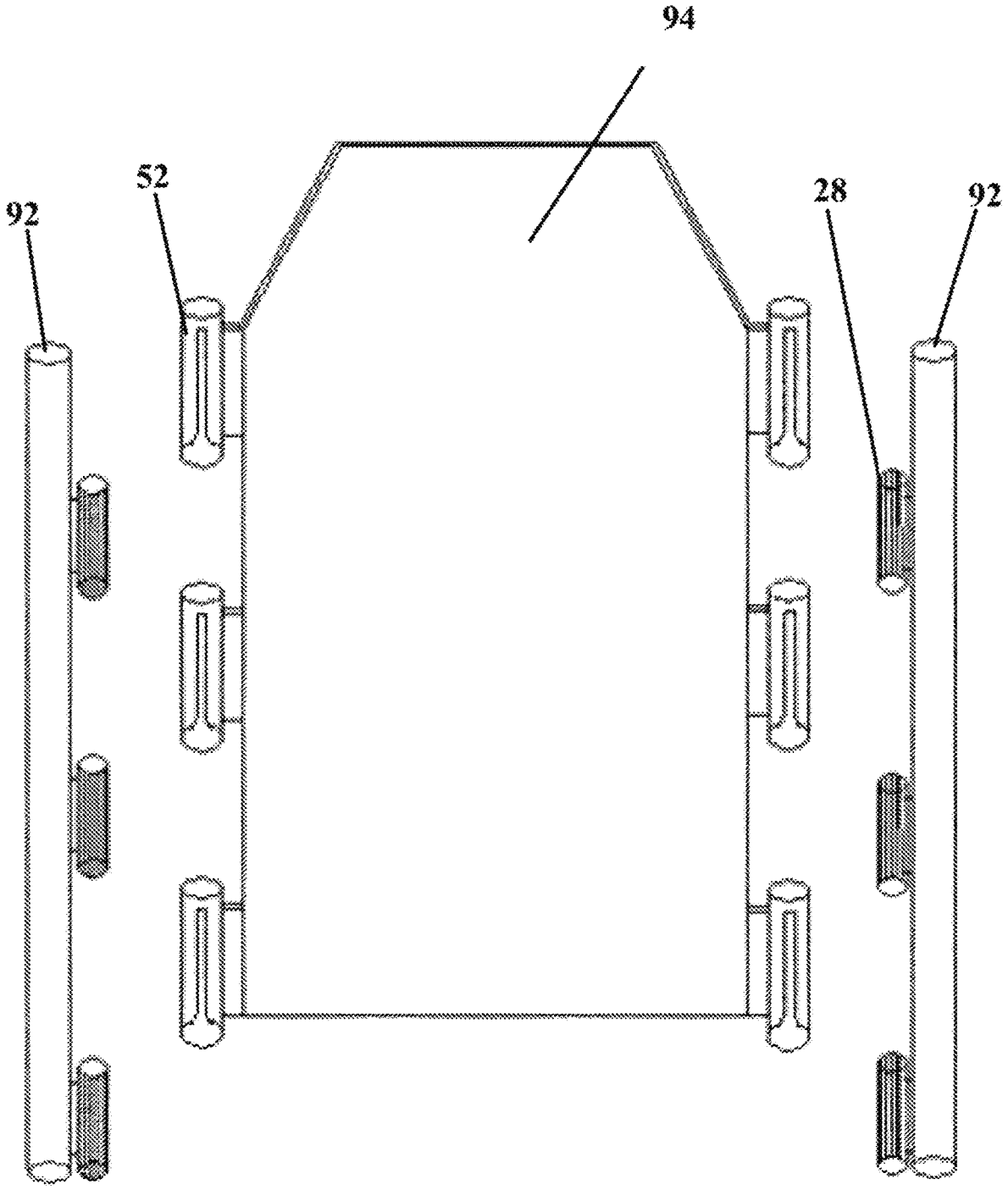

FIG. 13 depicts a back view of more than one anchor bar and an engagement clip body armor section according to an embodiment of the current disclosure.

Figure 14A:
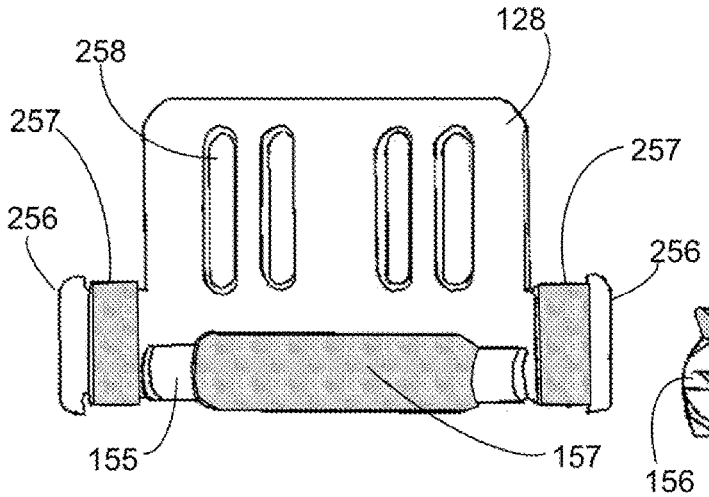

FIG. 14A depicts a frontal view of an anchor assembly of a garment engagement system according to an embodiment of the current disclosure.

Figure 14B:
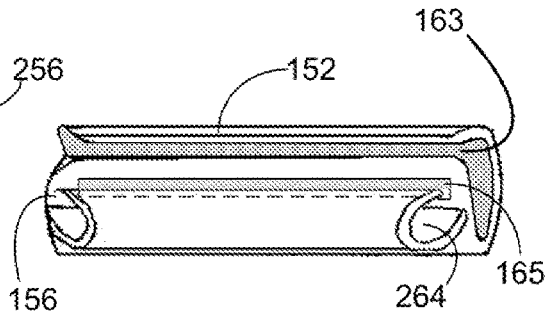

FIG. 14B depicts a longitudinal view of an engagement clip section of a garment engagement system according to an embodiment of the current disclosure.

Figure 15A:
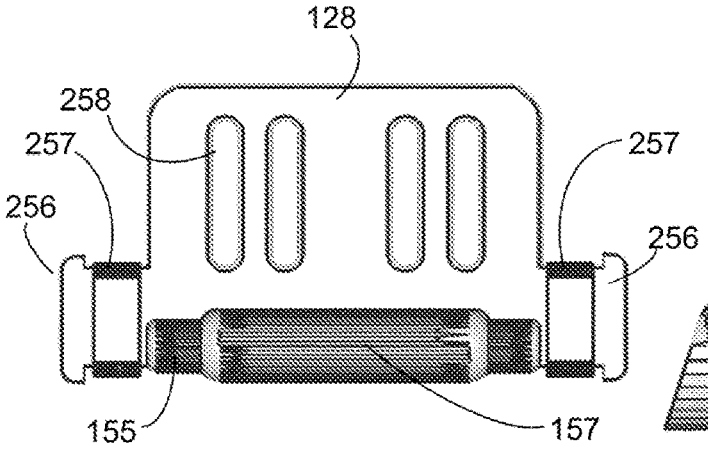

FIG. 15A depicts a frontal view of an anchor assembly of a garment engagement system according to an embodiment of the current disclosure.

Figure 15B:
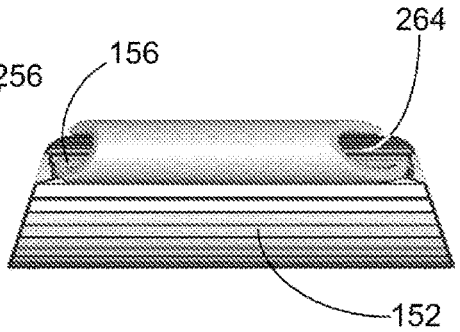

FIG. 15B depicts a frontal view of an engagement clip of a garment engagement system according to an embodiment of the current disclosure.

Figure 16A:
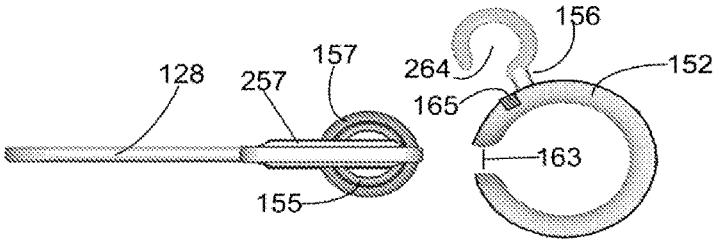

FIG. 16A depicts a side view of an anchor assembly and engagement clip section of a garment engagement system according to an embodiment of the current disclosure.

Figure 16B:
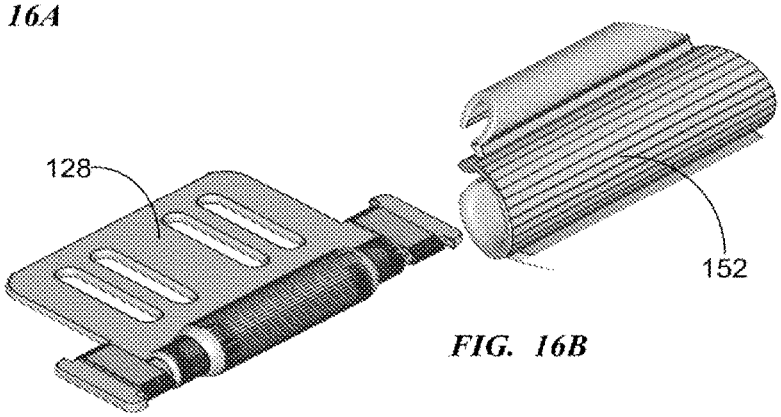

FIG. 16B depicts a longitudinal view of an anchor assembly and engagement clip section of a garment engagement system according to an embodiment of the current disclosure.

Figure 17A:
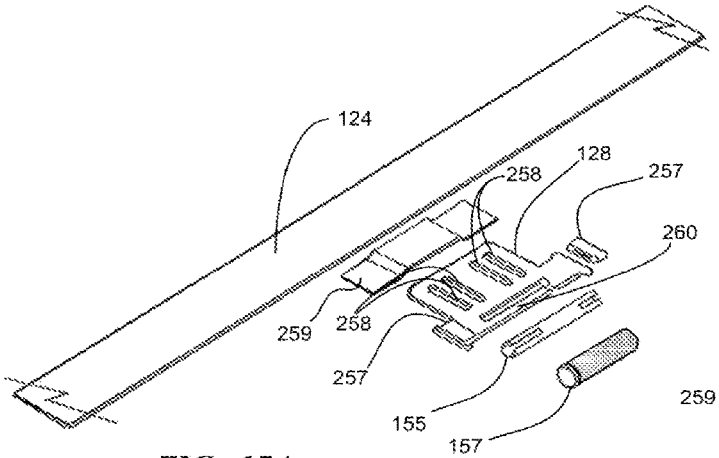

FIG. 17A depicts a longitudinal break out view of an anchor assembly of a garment engagement system according to an embodiment of the current disclosure.

Figure 17B:
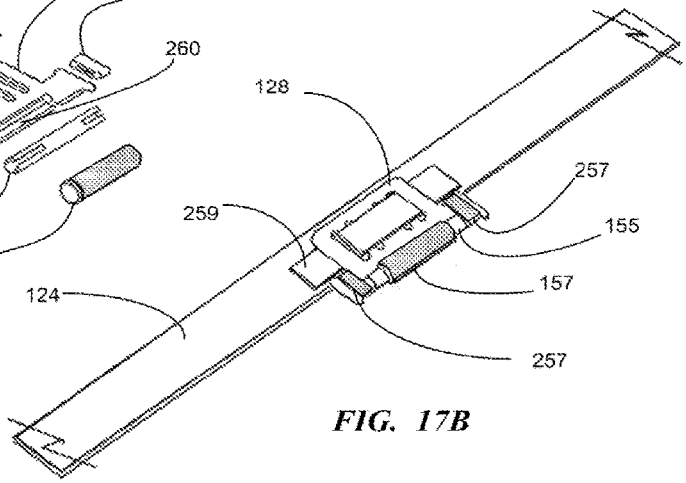

FIG. 17B depicts a longitudinal view of an anchor assembly with the component parts assembled of a garment engagement system according to an embodiment of the current disclosure.

Figure 18A:
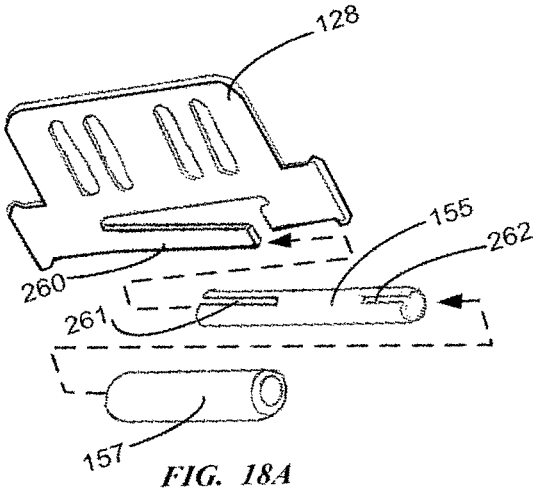
Figure 18B:
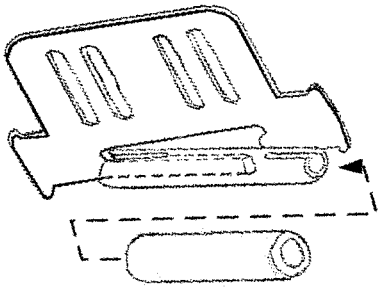
Figure 18D:
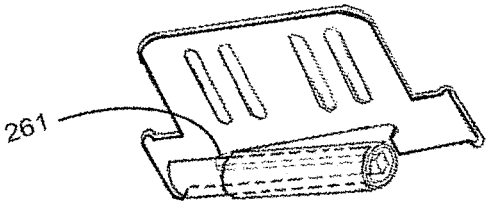
Figure 18C:
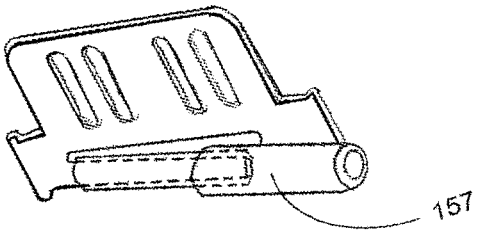
Figure 18F:
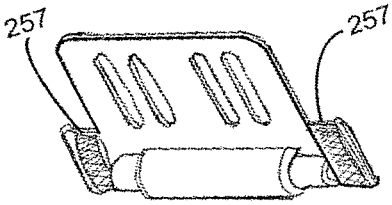
Figure 18E:
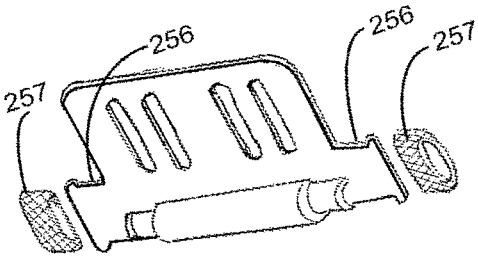
Figure 19:
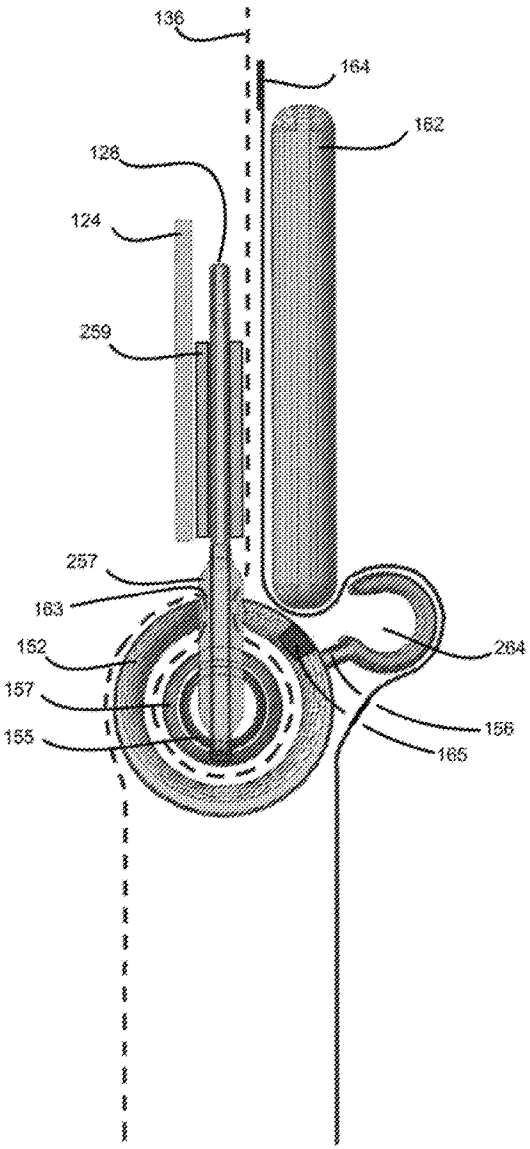

FIG. 18A thru FIG. 18F depicts a longitudinal sequential view of an anchor assembly FIG. 19 depicts a side view of a belt and garment engagement system engaging more than one garment according to an embodiment of the current disclosure.

Figure 20:
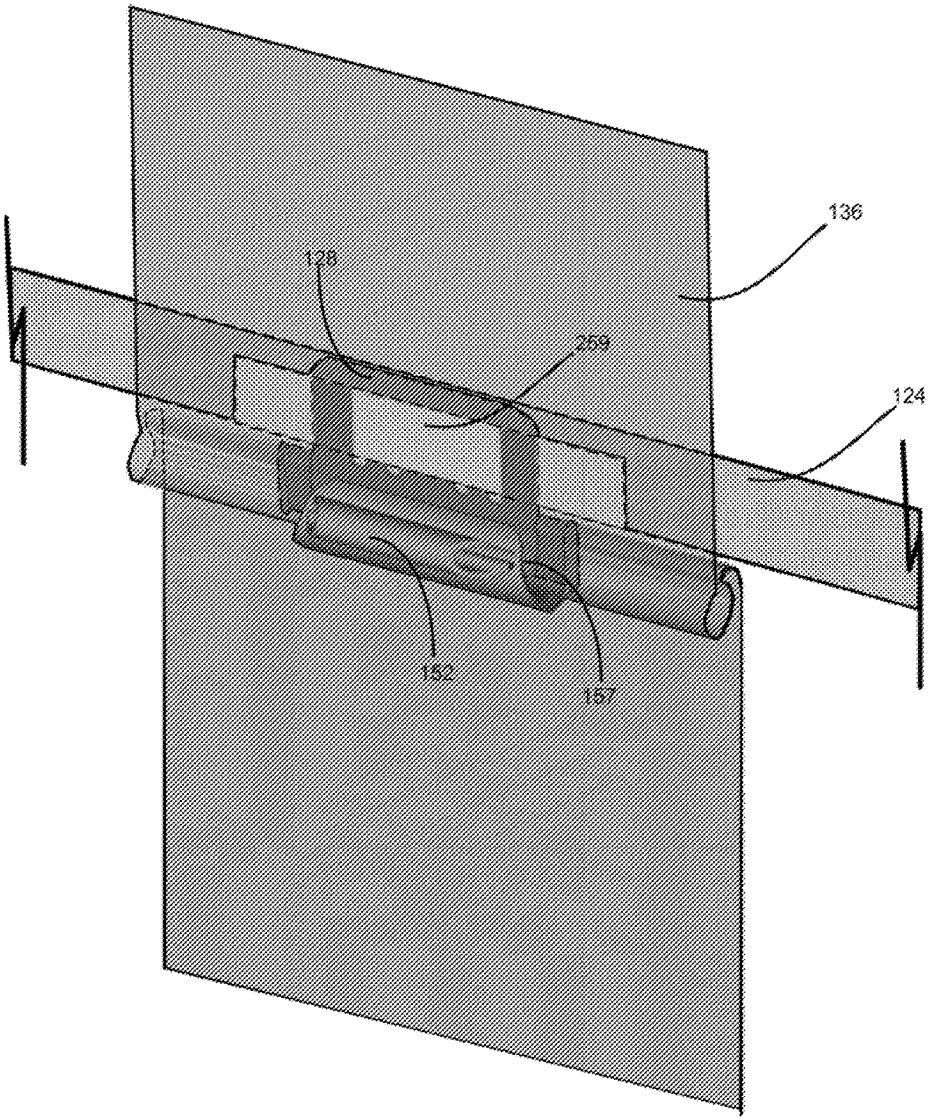

FIG. 20 depicts a longitudinal view of a garment engaged with a single garment according to an embodiment of the current disclosure.

Figure 21:
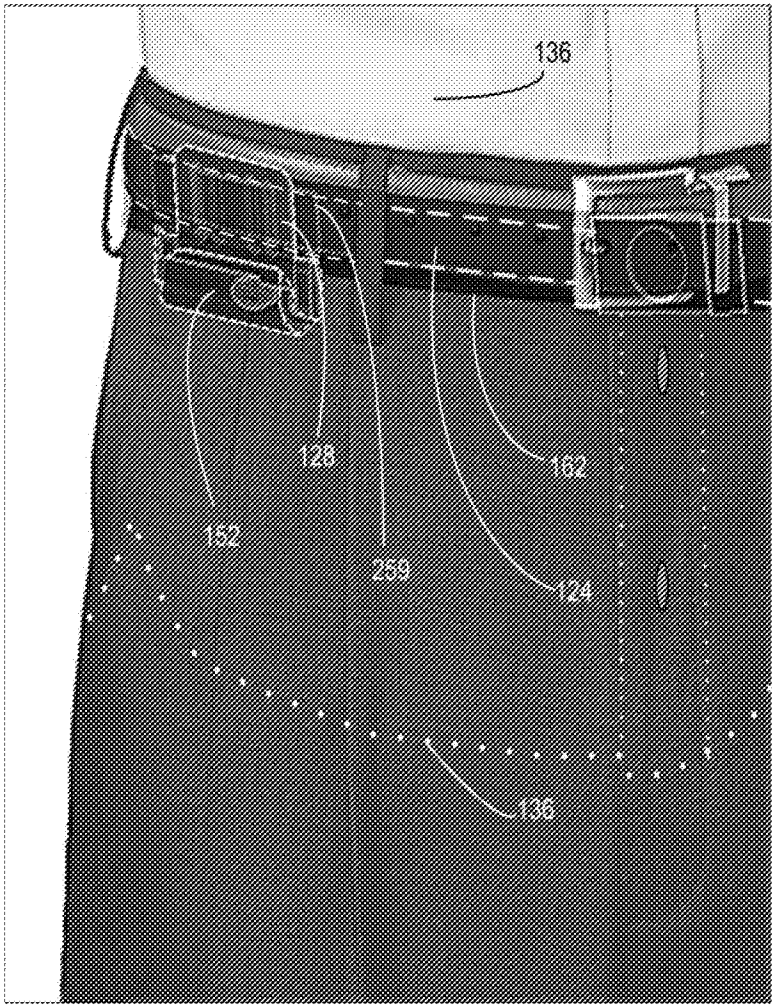

FIG. 21 depicts a front view of a garment engagement system engaging a garment while "hidden" under a pair of pants according to an embodiment of the current disclosure.

Figure 22:
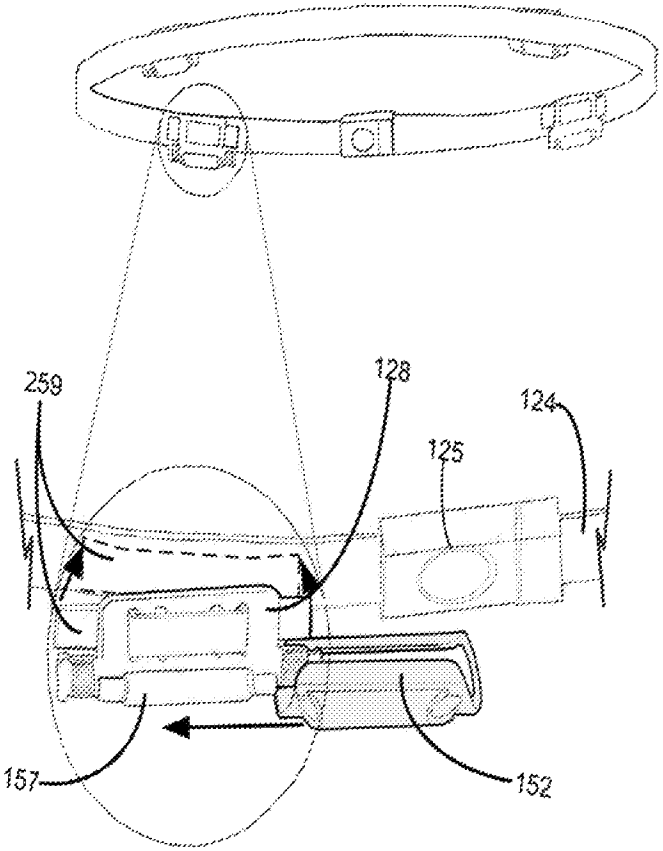

FIG. 22 depicts a magnified view of a belt and anchor assembly according to an embodiment of the current disclosure.

FIG. 23A depicts a top view of a swivel attachment device of a garment engagement system according to an embodiment of the current disclosure.

FIG. 23B depicts a side view of a swivel attachment device of a garment engagement system according to an embodiment of the current disclosure.

FIG. 23C depicts a front view of a swivel attachment device of a garment engagement system according to an embodiment of the current disclosure.

FIG. 24A thru 24D depicts a longitudinal view series showing the sequence of connecting and pivoting of the swivel attachment onto the engagement clip according to an embodiment of the current disclosure.

Figure 25:
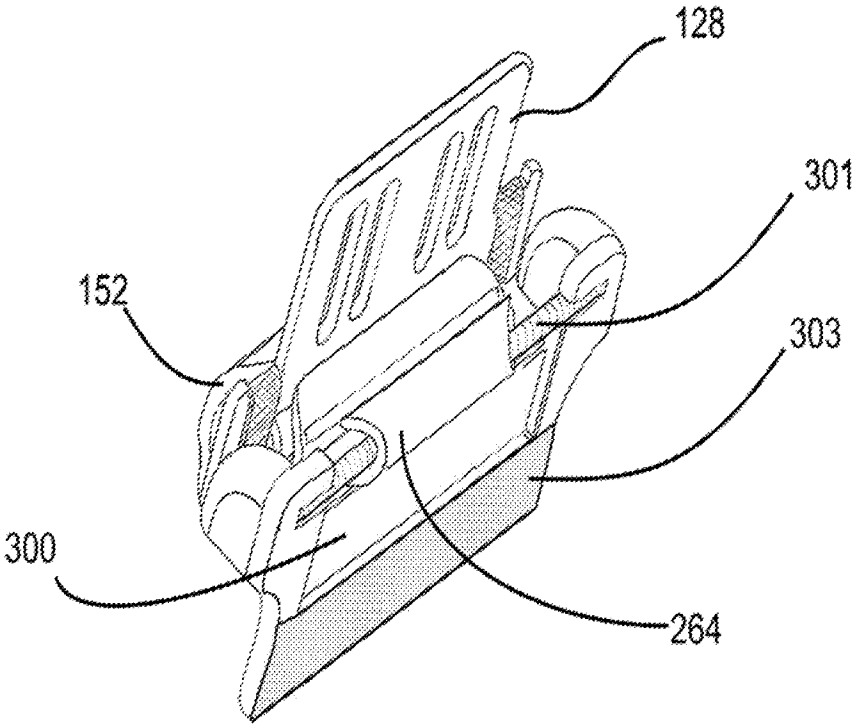

FIG. 25 depicts a longitudinal view of an assembled anchor assembly, engagement clip and swivel attachment device.

Figure 26:
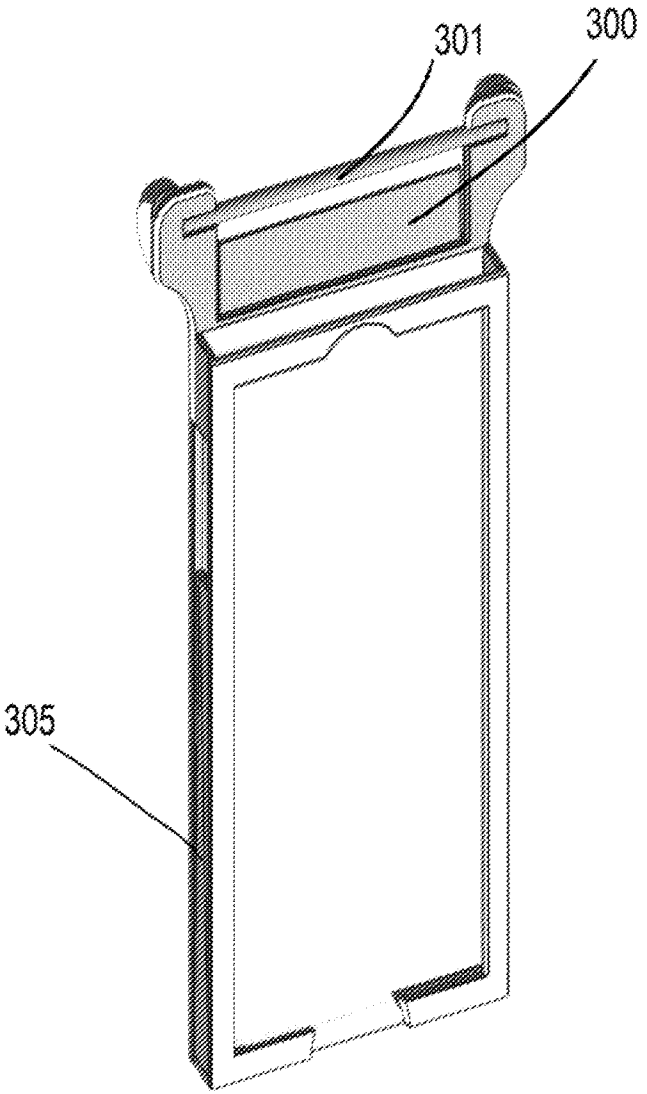

FIG. 26 depicts a longitudinal view of a swivel attachment device connected to an electronic device case.

DETAILED DESCRIPTION OF ILLUSTRATIVE EMBODIMENTS

The detailed description set forth below in connection with the appended drawings is intended as a description of exemplary embodiments in which the presently disclosed process can be practiced. The term "exemplary" used throughout this description means "serving as an example, instance, or illustration," and should not necessarily be construed as preferred or advantageous over other embodiments. The detailed description includes specific details for providing a thorough understanding of the presently disclosed method and system. However, it will be apparent to those skilled in the art that the presently disclosed process may be practiced without these specific details. In some instances, well-known structures and devices are shown in block diagram form in order to avoid obscuring the concepts of the presently disclosed method and system.

In the present specification, an embodiment showing a singular component should not be considered limiting. Rather, the subject matter preferably encompasses other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present subject matter encompasses present and future known equivalents to the known components referred to herein by way of illustration.

Reference now should be made to the drawings, in which the same reference numbers are used throughout the different FIGURES to designate the same components.

It will be understood that, although the terms first, second, third, etc. may be used herein to describe various elements, these elements should not be limited by these terms. These terms are only used to distinguish one element from another element thus; a first element discussed below could be termed a second element without departing from the teachings of the present disclosure.

The terminology used herein is for the purpose of describing particular embodiments only and is not intended to be limiting. As used herein, the singular forms "a", "an", and "the" are intended to include the plural forms as well, unless the context clearly indicates otherwise. It will be further understood that the terms "comprises" and/or "comprising" or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

The use of any and all examples, or exemplary language (e.g., "such as"), is intended merely to better illustrate the disclosure and does not pose a limitation on the scope of the disclosure unless otherwise claimed. No language in the specification should be construed as indicating any non-claimed element as essential to the practice of the disclosure as used herein.

Figure 1A:
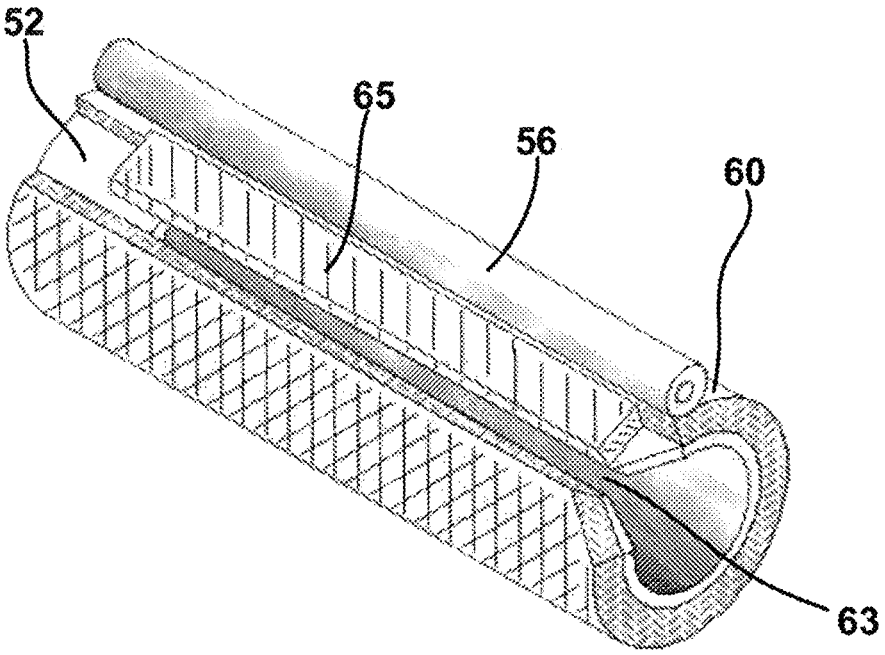
FIG. 1A depicts a longitudinal view of an engagement clip section of a garment engagement system according to an embodiment of the current disclosure.

FIG. 1A depicts a longitudinal view of an engagement clip section of a garment engagement system according to an embodiment of the present disclosure comprising a housing 60, an engagement clip 52, a belt ledge retainer 56, and a ferromagnetic element 65. The engagement clip 52 is provided as a covering for a flexible anchor 57 (FIG. 5) and is made to fit snugly over the flexible anchor 57 when the anchor 57 is either engulfed or not engulfed in a garment. The engagement clip 52 is preferably made of PVC tubing material but may also be made of one or more other polymers, woods, metals, or composites. A main function of the engagement clip 52 is the ability to slide over a covered or uncovered flexible anchor 57 (essentially providing enough "give" so a covered or uncovered flexible anchor 57 will neither resist sliding into the engagement clip 52 nor slide out of the engagement clip 52 too easily). An engagement clip 52 created from any material that will allow this function is an acceptable engagement clip 52. In order to allow for a smoother step of sliding a flexible anchor 57 engulfed in a garment into the engagement clip 52, the circumferential edges of engagement clip 52 may be rounded and/or smoothed. An engagement clip channel 63 exists on the engagement clip 52 (preferably three quarters of the length of the entire engagement clip) for the purposes of engaging an interior engagement clip 55 or a flexible anchor 57 and allowing passage of a securing wire 54 or a C-wire 42 found in other embodiments of the present disclosure (for example, see FIG. 2A, FIG. 2B, FIG. 9A, and FIG. 9B). The engagement clip channel 63 may also engage a portion of bunched up garment adjacent an anchor engulfed by the same garment (FIG. 4). The engagement clip channel 63 may be more or less than three quarters of the entire length of the engagement clip 52; in other embodiments, the engagement clip channel may span the entire length of the engagement clip. A belt ledge retainer 56 is positioned along the length of the housing 60 in order to keep the garment engagement system properly positioned below a user's belt while retaining a user's garment. The belt ledge retainer 56 may also assist in the support of a user's pants. Alternately the belt ledge retainer 56 may be positioned along the length of the engagement clip 52 to provide a lower profile.

A ferromagnetic element 65 is also shown spanning the length of the garment engagement system. The ferromagnetic element 65 shown may be used in conjunction with at least another ferromagnetic element to engage or "trap" pants and or any other type of garment. This provides decreased alignment problems and prevents the release of garments during more rigorous activities by a user of the garment engagement system. In certain embodiments, a garment engagement system may exclude ferromagnetic elements.

Figure 1B:
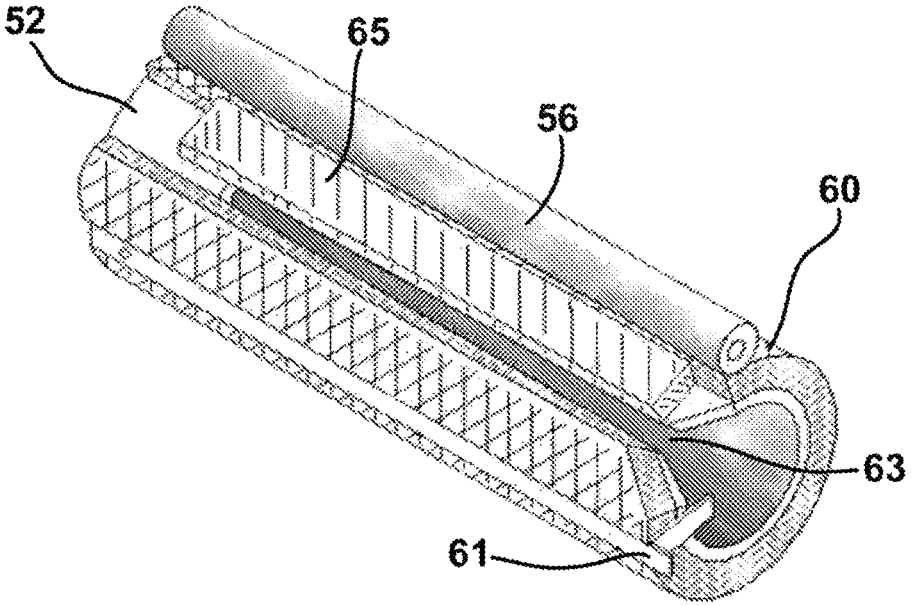
FIG. 1B depicts a longitudinal view of an engagement clip section of a garment engagement system with a retainer spring according to an embodiment of the current disclosure.

FIG. 1B depicts a longitudinal view of an engagement clip section of a garment engagement system with a retainer spring 61 according to an embodiment of the current disclosure. The retainer spring 61 may span the entire length of the engagement clip section and is used to retain the anchor 28 in position. The retainer spring 61 keeps the engagement clip 52 from becoming dislodged from the anchor 28 with excessive side to side motion exerted on the engagement clip 52. The engagement clip 52 is released from the anchor 28 by gently pulling up on the retainer spring 61 while sliding the engagement clip 52 free from the anchor 28 and garment. In another embodiment, the belt ledge retainer 56 and at least one ferromagnetic element 65 may separately span any length. For instance, the belt ledge retainer 56 and at least one ferromagnetic element 65 may span more than the length of the garment engagement system, the same length of the garment engagement system, or less than the length of the garment engagement system, or different lengths of the garment engagement system. In a further embodiment, one or both of the belt ledge retainer 56 and at least one ferromagnetic element 65 may span more or less than the length of the garment engagement system. In further embodiments, the anchor 28 may be a different length than the engagement clip 52 and/or housing 60.

In a further embodiment, at least one ferromagnetic element 65 may take the place of the belt ledge retainer 56. In yet another embodiment, the engagement clip 52 may be slideably attachable to the housing 60. The engagement clip 52 may slide in and out of the housing 60 when acted upon by a force. Once enveloped by the housing 60, the engagement clip 52 may be held sturdily in place by external pressure from the housing 60 in order to avoid movement by the engagement clip 52.

FIG. 2A depicts a securing wire 54. The securing wire 54 is a wire with ends bent at around 90 degrees. In other embodiments, the angles of the ends may vary (as long as the angle allows for the proper functionality of the securing wire 54). The tips of the ends of the wire comprise ovoid shaped bulges used in certain embodiments of the garment engagement system. The securing wire is preferably made of nylon cord but is not limited to this material. The securing wire 54 is shown in a side view of a compound anchor 28 as shown in FIG. 2B. The compound anchor 28 is defined by an inner slide section 55 and an outer casing 59. The securing wire 54 is contained in a securing belt 24 disposed about a user of the garment engagement system. The bent ends of the securing wire protrude out of the belt through two holes in the securing belt 24. The interior engagement clip section and securing wire 54 are coupled together using a sliding engagement mechanism. The outer casing 59 includes two holes 53 spaced the same length as the length between the ends of the securing wire 54. The inner slide section 55 includes two hole slide channels 51 spaced so that the holes 53 of the outer casing 59 line up with the wider ends of the hole slide channels 51 when the outer casing 59 is partially slid over the inner slide section 55 and so that the holes 53 of the outer casing 59 line up with a part of the hole slide channels 51 other than the wider ends of the hole slide channels 51 when the outer casing 59 is fully slid over the inner slide section 55. The compound anchor 28 may be utilized with a garment engagement system that comprises all non-metal parts. This non-metal system may be useful when a user prefers to avoid detection from a metal detector.

FIG. 3A depicts a side view of a belt and garment engagement system engaging more than one garment according to an embodiment of the current disclosure. A flexible anchor 57 is shown enveloped in a shirt 36 within the engagement clip 52. An end of a C-wire 42 attached to a securing belt 24 are shown entering the engagement clip channel 63 of the engagement clip 52. The end of the C-wire 42 is further shown penetrating the flexible anchor 57 through an opening on the end of the flexible anchor 57. On the exterior of the engagement clip 52 there exists a belt ledge retainer 56 engulfed in a pair of pants 64. The belt ledge retainer 56 presses against a belt 62 and provides a force against the belt which the garment engagement system uses to restrict movement of the system. Other embodiments may exclude the use of a belt ledge retainer 56. Garment engagement systems utilizing a C-wire 42 and a flexible anchor 57 may be useful in situations where bearing weight is a necessary task.

FIG. 3B displays a side view of an embodiment of the system similar to that of the embodiment shown in FIG. 3A. The embodiment shown in FIG. 3B further comprises a first ferromagnetic element 65 and a second ferromagnetic element 66. A first ferromagnetic element 65 is shown substituting for the edge of the engagement clip 52 adjacent to the opening and on the external side of the shirt 36. A second ferromagnetic element 66 is shown resting above the pants 64 and the first ferromagnetic element 65 so that the pants 64 are entrapped between the first ferromagnetic element 65 and the second ferromagnetic element 66. A magnified view of the second ferromagnetic element 66 is further shown in FIG. 3B. The second ferromagnetic element's external surface area is mostly wrapped in a casing 68. On one side of the ferromagnetic element cover, there exists a removal protrusion 70 that functions to remove the second ferromagnetic element 66 from the magnetic field of the first ferromagnetic element 65 when pulled with a great enough force. In another embodiment, the casing 68 and/or the removal protrusion 70 may be absent from the system.

FIG. 4 depicts a front/internal view of a flexible anchor 57 engulfed in a garment. The internal view helps define the cylindrical shape of the flexible anchor 57. The parallel dotted lines surrounding the flexible anchor 57 help to define a securing belt 24 used in conjunction with certain embodiments of the disclosure.

FIG. 5 expands on the embodiment of FIG. 4 and depicts a flexible anchor 57 partially engulfed in an engagement clip 52 and housing 60. The flexible anchor 57 (either engulfed or not engulfed in a garment) must have a diameter smaller than that of the interior of an engagement clip 52 so that the flexible anchor 57 may slide comfortably into the engagement clip 52.

FIG. 6 depicts a front view of a garment engagement system engaging a garment while "hidden" behind a pair of pants according to an embodiment of the current disclosure. The depiction is essentially a front and more realistic view of the views found in FIG. 3A and FIG. 3B due to the fact that it shows the system performing the act of keeping a user's shirt in place while engaging the belt of the user. The system can be found just below the belt and is shown to bulge slightly when under a user's pair of pants.

FIG. 7 expands slightly on the embodiment found in FIG. 6 and shows an internal view of the garment engagement system worn by a user. The housing 60 and engagement clips 52 (not shown; inside housing 60) of each system are shown attached to compound anchors 28 engulfed in a garment (found inside the housing 60 and engagement clips 52). A belt ledge retainer 56 above the housing 60 engages the belt 38. The dotted line is representative of a securing belt 24 that utilizes securing wires 54 to help keep the systems in place.

FIG. 8 depicts a user utilizing a garment engagement system on the exterior of a shirt. The setup is essentially the same as that found in FIG. 7 except that the garment engagement system and securing belt 24 is still out of view but the engagement clips 52, housing 60 and belt ledge retainer 56 are still in plain view.

FIG. 9A depicts a front view of a belt and flexible anchors 57 according to an embodiment of the current disclosure. This embodiment utilizes a securing belt 24 in conjunction with four flexible anchors 57 dispersed on C-wires 42 protruding from the securing belt 24. When worn by a user, the belt-system combination allows a user to evenly space and position the C-wires 42 and flexible anchors 57 horizontally around the user's waist and provides a consistent attachment platform to set the elevation of the garment engagement system in preparation for the attachment to the outer shirt. The C-wires 42 are similar in shape to the letter "C", hence the name C-wires 42. The securing belt 24 includes a release buckle 26 used to remove the securing belt 24 from a user. In other embodiments, the securing belt 24 may include more or less than four flexible anchors 57.

FIG. 9B depicts a magnified view of a C-wire 42 and a flexible anchor 57 found in FIG. 9A. The C-wire 42 is shown penetrating two orifices 48 embedded in the securing belt 24 using the top and bottom sections of the C-wire 42. A flexible anchor 57 is removably positioned on the bent ends of the C-wire 42. The flexible anchor 57 comprises two spaced segments 58, wherein the inner diameter of the flexible anchor 57 is larger than that of the outer diameters of the two tube segments 58. The anchor 57 is bendable, allowing the flexible anchor 57 to easily be taken off or placed on the bent ends of the C-wire 42.

FIG. 10A depicts a front view of an anchor plate section 72 of an electronic device and eyeglass holder according to an embodiment of the current disclosure. Two anchors 28 are found on opposite sides of the anchor plate section 72. The section may be placed under a garment and is held in place by two ferromagnetic elements 74 and 76. A first ferromagnetic element 74 is attached to the body of the anchor plate section 72. This first ferromagnetic element 74 magnetically engages a second ferromagnetic element 76 and in the process entraps a section of garment in between the first and second ferromagnetic elements 74 and 76 so that the anchor section 72 is held in place. FIG. 10B depicts a front view of an engagement clip section 78 of the electronic device and eyeglass holder. When the anchor plate section 72 is secured behind a garment, the engagement clips 52 may be slid over the anchors 28 of the anchor plate section 72 so that the garment is entrapped between the anchors 28 and the engagement clips 52. The engagement clip section 78 is held in place using engagement clip channels 63 on the engagement clips 52 that extend from the bottom of the engagement clips 52 to less than the entire length of the engagement clips 52. This allows for the engagement clip channels 63 to sit snugly on anchor protrusions 80 extending from the anchor section 72. A strap 82 is positioned on the body of the engagement clip section 72 to allow for an electronic device or eyeglass holder to be held securely to the engagement clip section 78. To keep the electronic device or eyeglass case in place, the strap 82 may wrap around the electronic device or eyeglass case and permeate the engagement clip section 78 on both sides of where an electronic device or eyeglass case may exist. The strap may utilize Velcro in order to attach to itself, as seen in FIG. 10C depicting the engagement clip section 78 and the strap 82 with a Velcro attachment. In further embodiments, the strap 82 may comprise an affixing means other than Velcro.

FIG. 11A depicts a front view of an engagement clip pocket section according to an embodiment of the current disclosure. Engagement clips 52 are affixed to opposite sides of a pocket 84 and are attached to a garment engulfed anchor section 72 (similar to the anchor section 72 of the embodiment of FIG. 10A).

FIG. 11B depicts a top view of the engagement clip pocket section and anchor plate section 72 when combined. The engagement clips 52 are removably attached to the anchors 28 using engagement clip channels 63 on the engagement clips 52 that extend from the bottom of the engagement clips 52 to less than the entire length of the engagement clips 52 so the engagement clips 52 may sit on anchor protrusions 86 extending from the anchor section 72.

FIG. 11C depicts a top view of the engagement clip pocket section and anchor section 72 when engaging a garment 87. The pocket may hold items such as, but not limited to, eye glasses.

FIG. 12A depicts a front view of a gun holster system according to an embodiment of the current disclosure. Engagement clips 52 are affixed to the top of a gun housing 88, which may engage with the anchors 28 of the gun holster anchor section 90. When the anchors 28 are enveloped in a garment, the engagement clips 52 may slide over the anchors 28, wherein the combination of the engagement clips 52 and the anchors 28 are similar to other embodiments.

FIG. 12B depicts a side view of a user wearing the gun holster anchor section 90 on the user's shoulder. The gun holster system may be worn on the shoulder to allow a user easy access to the gun attached to the gun holster system. In further embodiments, the gun holster system may include a second strap that is worn over the opposite shoulder that may further stabilize the entire gun holster system.

FIG. 13 depicts a back view of more than one anchor bar 92 and a body armor plate section 94 according to an embodiment of the current disclosure. Two anchor bars 92 are used to stabilize the body armor plate section 94. The anchor bars 92 may be engulfed in a garment and the engagement clips 52 may be slid onto the anchors 28 using engagement clip channels 63 (similar to the process in other embodiments). In other embodiments, the anchor bars 92 may attach to the body armor plate section 94 in places other than the sides of the body armor plate section 94. In further embodiments, one or more than two anchor bars 92 may be utilized.

In any of the stated embodiments, one or more combinations of engagement clips 52 and flexible anchors 57 and/or one or more combinations of engagement clips 52 and compound anchors 28 may be utilized.

In any of the stated embodiments, the shape of any combination of the housing 60, engagement clip 52, and/or anchor 28 may be a shape other than cylindrical. The combination may take any shape sufficient to allow the garment engagement system to carry out the duties that are required of the system. For example, any combination above may take the shape of an ovoid, a triangular prism, a rectangular prism, a hexagonal prism, or an octagonal prism. Any combination may also be flat in order to allow for the system to be better hidden from view. The above embodiments are examples and are intended merely to better illustrate the disclosure and do not pose a limitation on the scope of the disclosure unless otherwise claimed.

In any of the stated embodiments, a garment engagement system may be absent a housing 60. Furthermore, an embodiment of the garment engagement system such as the one stated above may include one or more belt ledge retainers 56 and/or one or more ferromagnetic elements 65 positioned along any length of an engagement clip 52.

In any of the stated embodiments, a housing 60 and/or an engagement clip 52 may include a textured interior and/or exterior. This added feature may serve to further secure any element of the garment engagement system or the garment engagement system as a whole.

The pattern of the textured exterior may include other patterns such as circles, lines, triangles, ovals, squares, and swirls and are not limited to these patterns. A specific pattern may be used on a housing 60 and/or engagement clip 52 as long as the pattern helps to further secure the garment engagement system.

In any of the stated embodiments, a garment engagement system may include one or more belt ledge retainers 56 separately located on opposite adjacent sides of the engagement clip channel 63. These more than one belt ledge retainers 56 may allow a garment engagement system to be use right side up or upside down.

In any of the stated embodiments, one or more housings 60 and/or one or more engagement clips 52 may be made of a flexible material. In any of the above stated embodiments, a compound anchor 28 may take the place of a flexible anchor 57 and a flexible anchor 57 may take the place of a flexible anchor 28. For example, a compound anchor 28 may associate with a C-wire 42 and a flexible anchor 57 may associate with a securing wire 54.

For the purposes of this disclosure, it is appreciated that the term garment may refer to any type of clothing worn by a human being, including but not limited to shirts, pants, shorts, t-shirts, vests, coats, jackets, ponchos, dresses, gowns, robes, cloaks, shawls, wraps, hosiery, skirts, spandex, suits, bathing suits, and underwear.

For the purposes of this disclosure, it is appreciated that the terms "system", "engagement system", and "and garment engagement system" refer to at least the combination of the engagement clip 52 and either a flexible anchor 28 and may comprise more elements than those stated, whether any of the combination or elements are singular or plural. For example, the use of "garment engagement system" may refer to a housing 60 and an engagement clip 52, a housing 60, an engagement clip 52, and a securing belt 24, or a housing 60, an engagement clip 52, and an anchor 28 (with the garment engagement system not being limited to any of the above embodiments).

For the purposes of this disclosure, it is appreciated that the terms "engagement clip channel" and "channel" are synonymous.

For the purposes of this disclosure, it is appreciated that the terms "flexible anchor" and "compound anchor" may both be referred to simply as an "anchor". In any of the above stated embodiments, any of the anchors referred to in this disclosure may be utilized in a garment engagement system without any referenced belt or referenced wire. The use of any and all examples, or exemplary language (e.g., "such as"), is intended merely to better illustrate the disclosure and does not pose a limitation on the scope of the disclosure unless otherwise claimed. No language in the specification should be construed as indicating any non-claimed element as essential to the practice of the disclosure as used herein.

FIG. 14A the anchor tab 128 also referred to as an anchor assembly (when all defined components are assembled onto the anchor tab as a unit) is defined by a semi-rigid plate which defines a space to receive a locking retainer tube 155 and an anchor outer casing 157. Protruding tabs 256 receive the limiting compression bands 257 of variable thicknesses which are locked in place by the hooked ends of the protruding tabs 256. Vertical elongated channels 258 provide a means to removably attach a fabric strip to a securing belt 124 by snaking the fabric strip between channels then attaching to the securing belt 124. A limiting compression band 257 allows for the edges of the engagement clip channel 163 (FIG. 14B) to pass across the limiting compression band boundary and come to rest between the bands creating a stable homed position during engagement and resist accidental clip dislodgment. Variable thickness of the limiting compression band 257 allows for customization of garment thickness by providing more or less friction applied against the engagement clip channel 163 during clip engagement. FIG. 14B depicts a longitudinal view of an engagement clip section of a garment engagement system according to an embodiment of the present disclosure comprising an engagement clip 152, a belt ledge retainer 156, a belt ledge grabbing channel 264, and a ferromagnetic element 165. A ferromagnetic element 165 shown may be used in conjunction with at least another ferromagnetic element (not shown) to engage or "trap" pants and or any other type of garment. This provides decreased alignment problems and prevents the release of garments during more rigorous activities by a user of the garment engagement system. In certain embodiments, a garment engagement system may exclude ferromagnetic elements. The engagement clip 152 is provided as a covering for an anchor outer casing 157 (FIG. 14A) and is made to fit snugly over the anchor outer casing 157 when the anchor outer casing 157 is engulfed in a garment (garment not shown). The engagement clip 152 is preferably made of PVC tubing material but may also be made of one or more other polymers, woods, metals, or composites. A main function of the engagement clip 152 is the ability to slide over a covered anchor 157 (essentially providing enough "give" so a covered anchor 157 will neither resist sliding into the engagement clip 152 nor slide out of the engagement clip 152 too easily). An engagement clip 152 created from any material that will allow this function is an acceptable engagement clip. In order to allow for a smoother step of sliding an anchor outer casing 157 engulfed in a garment into the engagement clip 152, the circumferential edges of the engagement clip 152 may be rounded and/or smoothed. An engagement clip channel 163 exists on the engagement clip 152 for the purposes of engaging an anchor tab 128. The engagement clip channel 163 may span the entire length of the engagement clip 152 or only three quarters of the length of the entire engagement clip 152 for the purpose of vertical alignment. A belt ledge retainer 156 is positioned along the length of the housing 152 to provide a surface for the user's belt to rest. The belt ledge retainer 156 may also assist in the support of a user's pants and the grabbing channel 264 provides an additional holding edge to prevent slippage. Alternately, the belt ledge grabbing retainer 156 provides a grabbing channel 264 to receive a rigid tubular bar providing a connection for the swivel connector 300 (FIG. 25). A ferromagnetic element 165 is also shown spanning the length of the garment engagement system. The ferromagnetic element 165 shown may be used in conjunction with at least another ferromagnetic element to engage or "trap" pants and or any other type of garment. This provides decreased alignment problems and prevents the release of garments during more rigorous activities by a user of the garment engagement system. In certain embodiments, a garment engagement system may exclude ferromagnetic elements FIG. 15A depicts a front view of the garment engagement system.

FIG. 15B depicts a front view of the garment engagement system.

FIG. 16A depicts a side view of the garment engagement system.

FIG. 16B depicts a longitudinal view of the garment engagement system.

FIG. 17A depicts a front longitudinal view of anchor assembly component breakout.

FIG. 17B depicts a front longitudinal view of the component finished assembly.

FIG. 18A-18F depicts the anchor assembly sequence where the anchor tab has a retainer tube rail 260 that will flex to allow the locking retainer tube 155 to slide over and around the rail 260 (FIG. 18B) With this in position the anchor outer casing 157 can slide over both the rail 260 and the locking retainer tube 155 (FIG. 18C) allowing the locking retainer tube slot 261 to fully butt against the anchor tab 128 wall. The locking retainer tube 155 and the anchor outer casing 157 align to clear the retainer tube rail end and re-position the rail to the rails home position (FIG. 18D). Together the locking retainer tube 155 and the anchor outer casing 157 slides covering the exposed slit in the rail. (FIG. 18E) Addition of the limiting compression bands 257 on each end of the protruding tab 256 effectively prevents the locking retainer tube 155 and anchor outer casing 157 from further sliding horizontally. (FIG. 18F) the limiting compression bands 257 allow the engagement clip channel 163 to slide over the bands 257 with controlled friction then also provide bump stops preventing the engagement clip 152 from sliding off prematurely and the entire anchor assembly 128 in an interlocked state.

FIG. 19 depicts a side view of a belt and garment engagement system engaging more than one garment according to an embodiment of the current disclosure. An anchor outer casing 157 is shown enveloped in a shirt 136 within the engagement clip 152. The top portion of an anchor tab 128 is attached to a securing belt 124 and is shown entering the engagement clip channel 163 of the engagement clip 152. The end of the anchor tab 260 (not shown) attached to the inner slide section 155 and the cylindrical body of the anchor outer casing 157. On the exterior of the engagement clip 152 there exists a belt ledge retainer 156 engulfed in a pair of pants 164. The belt ledge retainer 156 presses against an external belt 162 and provide a force against the belt which the garment engagement system uses to restrict movement of the pants 164 and external belt 162. Because the engagement system is also restricting motion of the garment 136, the belt 162 is unable to travel past the belt ledge retainer 156 thus providing support to the belt, anything attached to the belt and the pants.

FIG. 20 depicts a front longitudinal view of an engagement clip enveloped in a single garment attached to a securing belt 124. Show is the securing belt 124 furthest to the rear and the anchor assembly 128 is positioned between the securing belt 124 and the garment 136 secured with a fabric strip 259. Preparation for the attachment of the engagement clip is performed by using the fingertips and tucking the garment up between the anchor assembly 128 and the body, one half the width of the anchor assembly 128. (the body, not shown, is to the rear of the securing belt 124) The engagement clip 152 can then easily slide over the end of the anchor outer casing 157 and become slideably attached by the engagement clip 152 engulfing the garment 136.

FIG. 21 depicts a front view of a garment engagement system engaging a garment while "hidden" behind a pair of pants according to an embodiment of the current disclosure. The depiction is essentially a front and more realistic view of the views found in FIG. 14A and FIG. 14B due to the fact that it shows the system performing the act of keeping a user's shirt 136 in place while engaging the external belt of the user 162. The garment engagement system can be found just below the external belt and is shown to bulge slightly when under a user's pair of pants. The depiction shows an internal view of the garment engagement system worn by a user. The anchor assembly 128, engagement clip 152 and anchor outer casing 157 (not shown; inside engagement clip 152) of each system are shown attached to the anchor assembly 128 engulfed in a garment (found inside the engagement clip 152). A belt ledge retainer 156 provides a resting point for the outer belt 162 and belt ledge grabbing channel 264 engages the outer belt 162 preventing the belt from sliding past below the belt ledge retainer. The dashed line is representative of a securing belt 124 that utilizes a connected fabric strip 259 to help keep the systems in place and the dotted line represents the shirt 136 beneath the pants.

FIG. 22 depicts a magnified view of an anchor assembly 128 and an anchor assembly 128 found in FIG. 21. A fabric strip 259 is removably positioned onto anchor tab 128 by snaking through the vertically elongated channels 258. The anchor tab 128 is shown attaching to the securing belt 124 using a sewn or Velcro attachment method. This depiction shows the stable mounting of the anchor assemblies 128 so that the system can be easily adjusted and keeping the multiple anchor assemblies 128 operating as a single unit and released with a buckle 125.

FIG. 23A depicts a top view of a swivel connector 300 made of rigid plastic, metal, bamboo or other material that is rectangle with horizontal slots cut so that a tubular retainer bar 301 may be suspended substantially free and away from surfaces in proximity allowing the free connection of an elongated tubular channel present in the belt ledge grabbing channel 264. FIG. 23C the mounting surface 303 is flat and can provide a surface area for an adhesive pad or other bonding material designed to attach an external device, carry case, portable pocket or electronic device. FIG. 23B two crescent standoffs 302 on each end of the tubular retainer bar 301 push away from the external surface facing the GES when the swivel connector 300 is attached to the belt ledge grabbing channel 264 and pivots on the tubular retainer bar 301 exerting pressure creating a locking of the tubular retainer bar 301 inside the belt ledge grabbing channel 264

FIG. 24A thru 24D depicts a four diagram series showing the connection of the swivel connector 300 to the engagement clip 152. The swivel connector 300 tubular retainer bar 301 engages the engagement clip belt ledge grabbing channel 264. The pivoting action of the swivel connector 300 pushes the tubular retainer bar 301 away from the engagement clip 152 and away from the channel opening thereby locking the swivel connector in place. Gravity holds the swivel connector 300 in a locked position and can be released by pivoting swivel connector 300 upward at a 90 degree angle releasing the pressure exerted by the standoffs 302.

FIG. 25 depicts an assembled anchor assembly 128, engagement clip 152, swivel connector 300 (garment is not shown) with the swivel connector 300 fully engaged in the locked position. The tubular retainer bar 301 can be seen nested into the belt ledge grabbing channel 264 (FIG. 26) depicts a swivel connector 300 fastened to the upper portion an electronic device case 305.

In summary, the present disclosure provides a method, system, and integrated apparel securing mechanism for anchoring an upper body clothing to lower body piece of clothing to preserve a neat appearance of a wearer throughout a variety of movements and over an extended period of time. The present disclosure includes an anchor mechanism for anchoring an upper body clothing and formed of a semi-rigid material. The anchoring tab positions and conceals the apparel securing mechanism within the upper body clothing, wherein the upper body clothing is formed of a shirt-weight fabric. The anchoring tab has a width of less than approximately six inches and a height of less than approximately four inches and a generally flat configuration for being concealed beneath the upper body clothing. A locking retainer tube removably engages the anchor tab and has a tubular form and a length of less than approximately four inches. The tubular form diameter is less than approximately one inch. An anchor outer casing affixes to and substantially surrounds the locking retainer tube.

The anchor outer casing and the locking retainer tube may be surrounded by the shirt-weight fabric. This, thereby firmly associates the shirt-weight fabric and, thereby, the upper body clothing with the anchoring tab. An engaging clip for engages a lower body clothing. The engaging clip firmly engages the shirt-weight fabric surrounding the anchor outer casing and the locking retainer tube to form a concealed and firm anchoring of the engaging clip with the anchor mechanism. The engaging clip may be formed of a semi-rigid material of a generally tubular form with an inner diameter sufficient for firmly receiving the shirt-weight fabric surrounding the anchor outer casing and the locking retainer tube, and a tubular length approximately equivalent to the locking retainer tube. The engaging clip further comprises a belt ledge grabbing channel for grabbing a belt surrounding the lower body clothing and using the belt for firmly positioning the engaging clip in fixed association with the lower body clothing. With this formation, the engaging clip and the anchor mechanism fixedly associates the upper body clothing with the lower body clothing while being concealed by the upper body clothing and the lower body clothing to thereby preserve a neat appearance of a wearer throughout a variety of movements and over an extended period of time.

The detailed description set forth herein in connection with the appended drawings is intended as a description of exemplary embodiments in which the presently disclosed subject matter may be practiced. The term "exemplary" used throughout this description means "serving as an example, instance, or illustration," and should not necessarily be construed as preferred or advantageous over other embodiments.

This detailed description of illustrative embodiments includes specific details for providing a thorough understanding of the presently disclosed subject matter. However, it will be apparent to those skilled in the art that the presently disclosed subject matter may be practiced without these specific details. In some instances, well-known structures and devices are shown in block diagram form in order to avoid obscuring the concepts of the presently disclosed method and system.

The foregoing description of embodiments is provided to enable any person skilled in the art to make and use the subject matter. Various modifications to these embodiments will be readily apparent to those skilled in the art, and the novel principles and subject matter disclosed herein may be applied to other embodiments without the use of the innovative faculty. The claimed subject matter set forth in the claims is not intended to be limited to the embodiments shown herein, but is to be accorded the widest scope consistent with the principles and novel features disclosed herein. It is contemplated that additional embodiments are within the spirit and true scope of the disclosed subject matter.

What is claimed is:

1. An apparel securing mechanism for anchoring an upper body clothing to lower body piece of clothing to preserve a neat appearance of a wearer throughout a variety of movements and over an extended period of time, comprising:

an anchor mechanism for anchoring an upper body clothing and formed of a semi-rigid material and further comprising:

an anchoring tab for positioning and concealing said apparel securing mechanism within said upper body clothing, said upper body clothing comprising a shirt-weight fabric, said anchoring tab having a width of less than approximately six inches and a height of less than approximately four inches and a generally flat configuration for being concealed beneath said upper body clothing;

a locking retainer tube for removably engaging said anchoring tab and having a tubular form and a length of less than approximately four inches, a tubular form diameter of less than approximately one inch;

an anchor outer casing affixed to and substantially surrounding said locking retainer tube, said anchor outer casing and said locking retainer tube for being surrounded by said shirt-weight fabric, thereby firmly associating said shirt-weight fabric and, thereby, said upper body clothing with said anchoring tab; and an engaging clip for engaging a lower body clothing, said engaging clip firmly engaging said shirt-weight fabric surrounding said anchor outer casing and said locking retainer tube for forming a concealed and firm anchoring of said engaging clip with said anchor mechanism;

said engaging clip formed of a semi-rigid material comprising a generally tubular form with an inner diameter sufficiently for firmly receiving said shirt-weight fabric surrounding said anchor outer casing and said locking retainer tube and a tubular length approximately equivalent to said locking retainer tube;

said engaging clip further comprising a belt ledge grabbing channel for grabbing a belt surrounding said lower body clothing and using said belt for firmly positioning said engaging clip in fixed association with said lower body clothing, whereby said engaging clip and said anchor mechanism fixedly associate said upper body clothing with said lower body clothing while being concealed by said upper body clothing and said lower body clothing to thereby preserve a neat appearance of a wearer throughout a variety of movements and over an extended period of time.

2. The apparel securing mechanism of claim 1 further comprising a housing, wherein the housing comprises an interior surface and an exterior surface.

3. The apparel securing mechanism of claim 2 wherein said interior surface of said housing is textured.

4. The apparel securing mechanism of claim 2 wherein said exterior surface of said housing is textured.

5. The apparel securing mechanism of claim 1 further comprising at least one ferromagnetic element that defines an additional space adapted to engage a belt, garment, or combination thereof.

6. The apparel securing mechanism of claim 5 wherein said at least one ferromagnetic element is adjacent to said exterior surface of said engagement clip.

7. The apparel securing mechanism of claim 5 wherein said at least one ferromagnetic element is removably attached to said apparel securing mechanism.

8. The apparel securing mechanism of claim 1 further comprising a belt with a length sufficient to circumnavigate said individual.

9. The apparel securing mechanism of claim 8 wherein said belt comprises at least one securing wire.

10. The apparel securing mechanism of claim 8 wherein said belt comprises at least one C-wire.

11. The apparel securing mechanism of claim 1 wherein said engagement clip is of a flexible material.

12. The apparel securing mechanism of claim 1 wherein said exterior surface of said engagement clip is textured.

13. The apparel securing mechanism of claim 1 wherein said interior surface of said engagement clip is textured.

14. The apparel securing mechanism of claim 1 wherein a diameter of said anchor mechanism is smaller in diameter than an interior surface of said engagement clip.

15. The apparel securing mechanism of claim 1 wherein said belt ledge grabbing channel is an elongated ridge.

16. The apparel securing mechanism of claim 1 wherein said belt ledge grabbing channel is at least one ferromagnetic element.

17. A method for anchoring an upper body clothing to lower body piece of clothing to preserve a neat appearance of a wearer throughout a variety of movements and over an extended period of time, comprising:

anchoring an upper body clothing using an anchor mechanism for formed of a semi-rigid material and further comprising the steps of:

positioning and concealing said apparel securing mechanism within said upper body clothing using an anchoring tab, said upper body clothing comprising a shirt-weight fabric, said anchoring tab having a width of less than approximately six inches and a height of less than approximately four inches and a generally flat configuration for being concealed beneath said upper body clothing;

removably engaging said anchor tab using a locking retainer tube having a tubular form and a length of less than approximately four inches, said tubular form diameter of less than approximately one inch;

surrounding said locking retainer tube using an anchor outer casing affixed to said locking retainer tube, said anchor outer casing and said locking retainer tube for being surrounded by said shirt-weight fabric, thereby firmly associating said shirt-weight fabric and, thereby, said upper body clothing with said anchoring tab; and engaging a lower body clothing using an engaging clip, said engaging clip firmly engaging said shirt-weight fabric surrounding said anchor outer casing and said locking retainer tube for forming a concealed and firm anchoring of said engaging clip with said anchor mechanism;

said engaging clip formed of a semi-rigid material comprising a generally tubular form with an inner diameter sufficiently for firmly receiving said shirt-weight fabric surrounding said anchor outer casing and said locking retainer tube and a tubular length approximately equivalent to said locking retainer tube;

grabbing a belt surrounding said lower body clothing using a belt ledge forming part of said engaging clip, said grabbing belt further comprising a grabbing channel for and using said belt for firmly positioning said engaging clip in fixed association with said lower body clothing, whereby said engaging clip and said anchor mechanism fixedly associate said upper body clothing with said lower body clothing while being concealed by said upper body clothing and said lower body clothing to thereby preserve a neat appearance of a wearer throughout a variety of movements and over an extended period of time.

* * * * *